US008091559B2

(12) United States Patent
Lund et al.

(10) Patent No.: US 8,091,559 B2
(45) Date of Patent: Jan. 10, 2012

(54) APPLICATOR FOR A HAIR TREATMENT COMPOSITION

(75) Inventors: Mark Thomas Lund, Sunningdale (GB); Paul James Smith, Twickenham (GB)

(73) Assignee: The Procter & Gamble COmpany, Cincinnati, OH (US)

( * ) Notice: Subject to any disclaimer, the term of this patent is extended or adjusted under 35 U.S.C. 154(b) by 752 days.

(21) Appl. No.: 12/135,283

(22) Filed: Jun. 9, 2008

(65) Prior Publication Data

US 2009/0095314 A1 Apr. 16, 2009

(30) Foreign Application Priority Data

Jun. 15, 2007 (EP) ..... 07110395

(51) Int. Cl.
*A61K 8/18* (2006.01)

(52) U.S. Cl. ..... 132/208; 132/270

(58) Field of Classification Search ..... 132/202, 132/208, 108, 112, 109, 110, 270
See application file for complete search history.

(56) References Cited

U.S. PATENT DOCUMENTS

| | | | |
|---|---|---|---|
| 2,272,409 | A | 2/1942 | Johnson |
| 2,310,295 | A | 2/1943 | Keele |
| 2,776,667 | A | 1/1957 | Fitzgerald |
| 3,030,968 | A | 2/1960 | Oberstar |
| 2,962,031 | A | 11/1960 | Bumgarner |
| 3,662,767 | A | 5/1972 | Murtha |
| 3,702,508 | A | 11/1972 | Netter |
| 3,921,647 | A | 11/1975 | Fisher |
| 4,020,854 | A | 5/1977 | Caruso |
| 4,108,184 | A | 8/1978 | Morganroth |
| 4,398,549 | A | 8/1983 | Thomas |
| 4,503,870 | A | 3/1985 | Peterson |
| 4,796,812 | A | 1/1989 | Grollier |
| 4,942,893 | A | 7/1990 | Trottier |
| 5,042,514 | A | 8/1991 | Bastien |
| 5,060,679 | A | 10/1991 | Christopher et al. |
| 5,279,313 | A | 1/1994 | Clausen |
| 5,535,764 | A | 7/1996 | Abramson |
| 5,554,197 | A | 9/1996 | Assini |
| 5,771,906 | A | 6/1998 | De Benedictis |
| 5,823,204 | A | 10/1998 | Todd |
| 5,848,730 | A | 12/1998 | Kawase |
| 5,971,645 | A | 10/1999 | Fukushima |
| 6,062,231 | A | 5/2000 | De Laforcade |
| 6,148,829 | A | 11/2000 | De Benedictis |

(Continued)

FOREIGN PATENT DOCUMENTS

| | | | |
|---|---|---|---|
| DE | 662702 | C1 | 7/1938 |

(Continued)

*Primary Examiner* — Rachel Steitz
(74) *Attorney, Agent, or Firm* — Melissa G. Krasovec; Laura R. Grunzinger

(57) ABSTRACT

The present invention relates to an applicator (1) which allows for precise, non-messy and even application of a hair treatment composition to a hair strand. The applicator (1) comprises a plate (10) movably joined by a connection (30) to a well (20) and at least one metering layer selected from non-wovens, foams or combinations thereof. The metering layer has a caliper of from 0.15 mm to 39.5 mm and a compressibility as defined herein of from 59% to 93%. The metering layer may be a first metering layer (50) and be laid upon the rim (222) of the well (20) or may be a second metering layer (60) and be laid upon the internal surface (101) of the plate (10), preferably along the perimeter (103).

24 Claims, 9 Drawing Sheets

U.S. PATENT DOCUMENTS

| | | | |
|---|---|---|---|
| 6,250,312 | B1 | 6/2001 | Dasilva |
| 6,427,701 | B1 | 8/2002 | Roth |
| 6,440,175 | B1 | 8/2002 | Stanley |
| 6,626,599 | B2 | 9/2003 | Delaforcade |
| 6,748,957 | B1 | 6/2004 | Giordano |
| 7,025,069 | B2 | 4/2006 | Thiebaut |
| 7,198,049 | B2 | 4/2007 | Elmer |
| 7,357,137 | B2 | 4/2008 | Husband |
| 7,425,220 | B2 | 9/2008 | Barrass |
| 7,475,688 | B2 | 1/2009 | Colacioppo |
| 7,543,591 | B1 | 6/2009 | Munsil |
| 2002/0114657 | A1 | 8/2002 | Gueret |
| 2002/0142027 | A1 | 10/2002 | Gueret |
| 2003/0007825 | A1 | 1/2003 | De Laforcade |
| 2004/0016064 | A1 | 1/2004 | Vena |
| 2004/0031502 | A1 | 2/2004 | Winckels |
| 2004/0089316 | A1 | 5/2004 | Hamilton |
| 2004/0182408 | A1 | 9/2004 | De LaForcade |
| 2005/0079192 | A1 | 4/2005 | Simon |
| 2005/0207153 | A1 | 9/2005 | Leleve |
| 2005/0211599 | A1 | 9/2005 | De La Mettrie |
| 2006/0042643 | A1 | 3/2006 | Delan |
| 2006/0064824 | A1 | 3/2006 | Godfrey |
| 2006/0090771 | A1 | 5/2006 | Ramet |
| 2006/0144415 | A1 | 7/2006 | Magee |
| 2006/0207036 | A1 | 9/2006 | Kennedy |
| 2007/0144550 | A1 | 6/2007 | Roher |
| 2007/0215170 | A1 | 9/2007 | Kennedy |
| 2007/0227620 | A1 | 10/2007 | Kunii |
| 2008/0000492 | A1 | 1/2008 | Mills |
| 2008/0083418 | A1 | 4/2008 | Glenn |
| 2008/0083419 | A1 | 4/2008 | Glenn |
| 2008/0083420 | A1 | 4/2008 | Glenn |
| 2008/0087292 | A1 | 4/2008 | Abergel |
| 2008/0087293 | A1 | 4/2008 | Glenn |
| 2008/0087294 | A1 | 4/2008 | Glenn |
| 2008/0110929 | A1 | 5/2008 | Stanley |
| 2008/0156817 | A1 | 7/2008 | Roseblade |
| 2008/0196734 | A1 | 8/2008 | Husband |
| 2008/0223386 | A1 | 9/2008 | Albisetti |
| 2008/0223391 | A1 | 9/2008 | Baker |
| 2008/0223393 | A1 | 9/2008 | Boyle |
| 2008/0257370 | A1 | 10/2008 | Perry |
| 2008/0308119 | A1 | 12/2008 | Smith |
| 2009/0050171 | A1 | 2/2009 | Barrass |
| 2009/0071496 | A1 | 3/2009 | Glenn |
| 2009/0084393 | A1 | 4/2009 | Baker |
| 2009/0084394 | A1 | 4/2009 | Baker |
| 2009/0084395 | A1 | 4/2009 | Glenn |
| 2009/0095314 | A1 | 4/2009 | Lund |
| 2009/0101159 | A1 | 4/2009 | Bonnafous |
| 2009/0152281 | A1 | 6/2009 | Bowes |
| 2009/0223531 | A1 | 9/2009 | Lund |

FOREIGN PATENT DOCUMENTS

| | | | |
|---|---|---|---|
| DE | 197639177 | U1 | 4/1977 |
| DE | 198805283 | U1 | 7/1988 |
| DE | 3138389 | C2 | 7/1990 |
| DE | 4041742 | A1 | 6/1992 |
| DE | 29616331 | U1 | 12/1996 |
| DE | 29917054 | U1 | 8/2000 |
| DE | 10259016 | A1 | 6/2004 |
| DE | 202004017014 | U1 | 6/2005 |
| DE | 20221665 | U1 | 11/2006 |
| DE | 102005058188 | A1 | 6/2007 |
| DE | 202007016018 | U1 | 4/2008 |
| EP | 1138374 | A1 | 10/2001 |
| EP | 1566114 | A1 | 8/2005 |
| EP | 1264559 | B1 | 11/2005 |
| EP | 1897459 | A1 | 3/2008 |
| EP | 1915920 | A1 | 4/2008 |
| EP | 1481605 | B1 | 8/2009 |
| FR | 2444421 | A1 | 7/1980 |
| FR | 2495905 | A1 | 6/1982 |
| FR | 2854778 | A1 | 11/2004 |
| FR | 2905833 | A1 | 3/2008 |
| GB | 274875 | A | 10/1927 |
| GB | 2242357 | A | 10/1991 |
| GB | 2383944 | A | 7/2003 |
| GB | 2384425 | A | 7/2003 |
| JP | 4-41305 | | 4/1992 |
| JP | 11-178630 | | 7/1999 |
| JP | 11-178639 | A | 7/1999 |
| JP | 2001-211925 | A | 8/2001 |
| JP | 2002-034636 | A | 2/2002 |
| JP | 2003-199623 | A | 7/2003 |
| JP | 2003-310337 | A | 11/2003 |
| WO | WO 93/02589 | A1 | 2/1993 |
| WO | WO 93/10687 | A1 | 6/1993 |
| WO | WO 98/43511 | A1 | 10/1998 |
| WO | WO 02/074129 | A1 | 9/2002 |
| WO | WO 2006/010354 | A1 | 2/2006 |

Fig.5.N.

APPLICATOR FOR A HAIR TREATMENT COMPOSITION

FIELD OF THE INVENTION

The present invention relates to an applicator which allows for precise, non-messy and even application of a cosmetic composition to fibres, preferably keratinous fibres. The applicator, which comprises a metering layer selected from non-wovens, foams or combinations thereof, is especially intended for a hair treatment composition to provide hair strand effects.

BACKGROUND OF THE INVENTION

Application of hair treatment compositions to distinct hair strands allows the user to achieve a different look than a full head application. Hair treatment compositions for providing a hair strand effects include highlighting compositions, dyeing compositions, perming compositions, styling compositions and mixtures thereof.

Hair strand effects such as those provided by highlighting compositions and dyeing compositions must be precisely applied where desired. For example, if a too abundant amount of highlighting composition is applied to the root, it may transfer to the neighbouring unselected hair strands. This may alter the overall end result and may totally disrupt the pattern that the user has tried to create. In addition, hair treatment compositions such as highlighting and dyeing compositions comprise components that need strong oxidants to bleach the melanin pigments. In view of its reactive chemical nature, most applications of highlighting and dyeing compositions if unexpectedly delivered in excess to the root-line, may also transfer to the scalp which can lead in some cases to unnecessary skin irritation. In addition, if an excessive amount of product is applied to the root, the colour effect will not be consistent along the length of the hair, leading to an undesired visual effect. If, instead, insufficient composition is applied to the hair strands, the evenness of the hair strand effect may not be achieved producing an end result which is visually unacceptable. Hence it is important that a consistent amount of product is applied uniformly along the hair strands being treated.

One known method for providing hair strand effects such as highlighting is the cap and hook system. A cap, provided with holes, is positioned over the head and hair strands are pulled out with a hook. Far from being accurate, the cap and hook system suffers from several drawbacks including random selection of the hair strands via the holes on the cap and the likelihood of applying the highlighting composition to only a portion of the selected hair strands and not to the root portion.

Several applicators have been designed for application of a hair treatment composition to independent bundles of hair strands as alternatives to the cap and hook system. These applicators belong to two general fields. One field comprises applicators based on combs and/or brushes. The other group comprises applicators having two articulated portions which are movable one relative to the other. Many attempts have been disclosed in this later field. U.S. Pat. No. 3,030,968 refers to an applicator for liquid treating material to be loaded by immersion. This applicator comprises a trough and a hair guide member mounted on the ends of the legs of a U-shaped resilient spring. The spring allows for manual compression and permits the hair guide member to fit into the trough. U.S. Pat. No. 6,062,231 discloses a device for applying a hair product to hair strands. This device comprises two articulated portions; the application means to be loaded by immersion and the retaining member to keep the hair strands on the applicator means while the device is in use. Another attempt is shown in US2003/0024544 wherein a device is disclosed provided with a cavity for the hair product and a retention member which is elastically deformable. The retention member may comprise porous or fibrous material and the cavity is provided with at least one notch to keep the hair strands in position during the application of the hair treatment composition.

It is generally recognized that the self-application of a composition to achieve hair strand effects are difficult per se, in particular those for highlighting and dyeing. To achieve the expected end results, an applicator capable of facilitating the self-application of a hair treatment composition needs to be conceived to address several technical challenges but in particular the applicator should evenly apply the composition to independent bundles of hair strands. Evenness is very important when the composition is a highlighting or dyeing composition. The permanent effect provided by these compositions is not immediately visible after the application and if the result is not appealing, it is not easily reversed. An applicator should hence ensure homogeneous coating along the length and width of the bundle of hair strands and likewise on the front and rear surfaces.

In addition, such applicators should apply an amount of hair treatment composition, which is sufficient to provide a hair strand effect without transferring to neighbouring strands or the scalp and skin. Furthermore, the applicator should not apply but then subsequently scrape off the hair treatment composition while the user moves the applicator along the bundle of hair strands. The application with such an applicator should also occur in a tidy and clean fashion without the hair treatment composition leaking out of the hair treatment applicator.

Finally, such an applicator for hair treatment compositions should be easy to use; it should be doubtless cheap and easy to produce and it should not require any special experience and training in matters such as how much and where to load the hair treatment composition. Ideally, the consumer should be able to load and use the applicator by simply following a few instructions provided by the manufacturer.

Thus, what still remains to be solved in the art is a hair treatment applicator capable of overcoming the technical problem defined above.

It has now been found that an applicator (as defined herein after) can significantly improve the application of a hair treatment composition to provide hair strand effects.

SUMMARY OF THE INVENTION

According to the invention, an applicator (1) for applying a hair treatment composition to the hair is provided, said applicator (1) comprising a plate (10) and a well (20); wherein said plate (10) comprises a perimeter (103), an internal surface (101) and an external surface (102); and wherein said well (20) comprises a bottom (201) and a wall (202), said wall (202) emerging from said bottom (201) and extending upwardly, said wall (202) having a rim (222) and said rim (222) defining an opening (203) and an internal volume (204) of said well (20); and wherein said plate (10) and said well (20) are movably joined by a connection (30) so that said applicator (1) may alternate between a closed state and an open state, wherein when said applicator (1) is in a closed state, said internal surface (101) of said plate (10) is in a juxtaposed relationship to said opening (203) of said well (20) and wherein when said applicator (1) is in an open state, said internal surface (101) of said plate (10) is in a distal relationship to said opening (203) of said well (20), wherein said applicator (1) in said closed state has an average distance (D1) from said perimeter (103) of said plate (10) to said rim (222) of said wall (202); wherein said applicator (1) comprises at least one metering layer and wherein said at least one metering layer is selected from a group consisting of non-wovens, foams and combinations thereof; and wherein said at least one metering layer has a compressibility as defined herein of from about 59% to about 93% and a calliper of from about 0.40 mm to about 21.88 mm, wherein the ratio of said at least one metering layer calliper to said average distance (D1) is defined by the mathematical relationship (I); wherein $$4.375 \times D1 \geqq \text{Calliper (mm)} \geqq 0.792 \times D1 \quad \text{(I)}$$

Furthermore, a method to apply a hair treatment composition to a hair strand whereby said hair strand is contacted with said applicator (1) according to the invention and a kit-of-part comprising an applicator (1) according to the invention is also described.

BRIEF DESCRIPTION OF THE DRAWINGS

in FIG. 5A a member (40) having a substantially pyramidal form; in FIG. 5B a plurality of tines (41); in FIG. 5C a member (40) having a substantially parallelepiped form.

in FIG. 5H waved, in FIG. 5L concave and in FIG. 5M is convex.

FIGS. 5N and 5P are perspective views of the internal surface (101) of a plate (10) of an embodiment of said applicator (1) according to the invention. A first (70) and a second (71) fin project from said internal surface (101) of said plate (10), in FIG. 5N said fins (70; 71) and their proximal edges (90; 91) are curved, whilst in FIG. 5P said fins (70; 71) have protrusions (75).

DETAILED DESCRIPTION OF THE INVENTION

For the purpose of this invention, the term hair refers to both living hair i.e. on a living body and to non-living hair i.e.

in a wig, hairpiece or other aggregation of non-living keratinous fibre. Mammalian, preferably human hair is intended.

For the purpose of this invention, the term "laid upon" is generally used to indicate the location of the feature to which it refers and not the act of locating it.

The present invention is characterized by the synergistic relationship that the features as described herein have when combined together in the specific relationship selected within the present invention to solve the above technical problem.

Figure 1A:
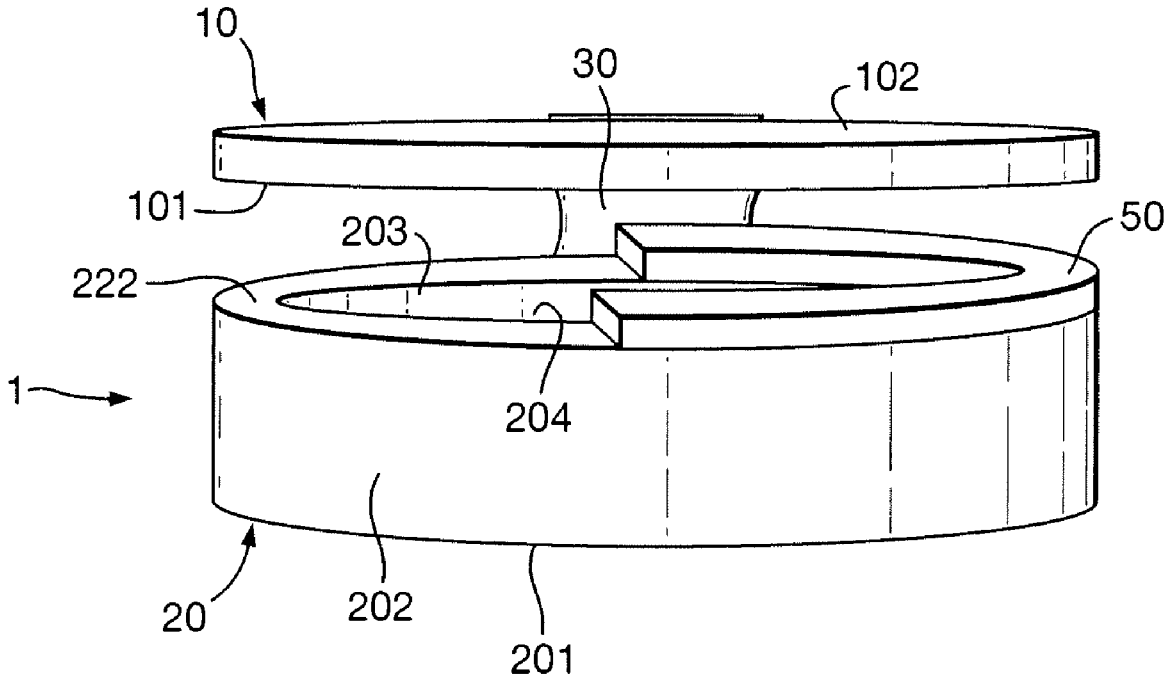
FIG. 1A is a perspective view of an embodiment of said applicator (1) according to the invention. Said applicator comprises a plate (10), a well (20) and a connection (30). In this embodiment, a first metering layer (50), part of which has been removed to show the rim (222), is laid upon said rim (222) of said wall (202) of said well (20). The applicator (1) is shown herein in an open state, whereby said internal surface (101) of said plate (10) is in a distant relationship to said opening (203) of said well (20).
Figure 1B:
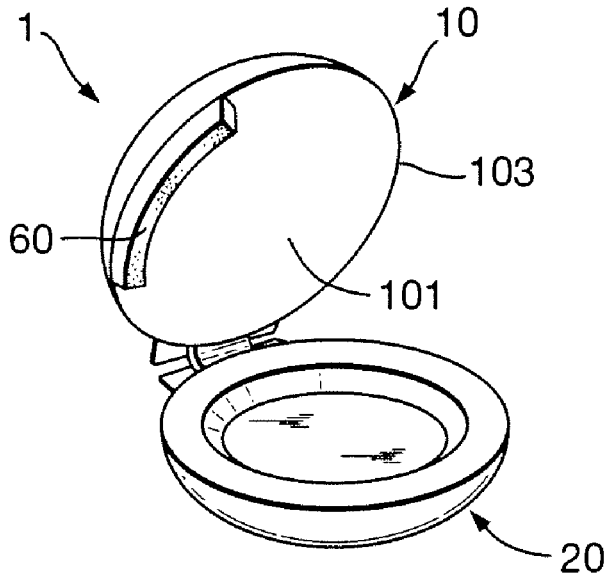
FIG. 1B shows a perspective view of an embodiment of the applicator (1) according to the invention comprising a plate (10) and a well (20). In this embodiment said at least one metering layer is a second metering layer (60) laid upon said internal surface (101) of said plate (10) along said perimeter (103) of said plate (10).

To achieve the technical effect described herein, the applicator (1) for applying a hair treatment composition to the hair according to the present invention comprises a plate (10) and a well (20) as shown in FIG. 1A. A connection (30) movably joins said plate (10) to said well (20). Said plate (10) comprises a perimeter (103), an internal (101) and an external surface (102). Said well (20) is formed by a bottom (201) and a wall (202), said wall (202) emerging from said bottom (201) and extending upwardly. Said wall (202) comprises a rim (222), said wall (202) and said rim (222) define an opening (203) and an internal volume (204) of said well (20) as shown in FIG. 1. Said plate (10) and said well (20) are movably joined by said connection (30), so that said applicator (1) can alternate from an open state to a closed state. In this latter state, said internal surface (101) of said plate (10) is in a juxtaposed relationship to said opening (203) of said well (20).

When said applicator (1) is in a closed state, it comprises an average distance (D1) from said perimeter (103) of said plate (10) to said rim (222) of said wall (202). Said average distance (D1) is preferably from 0.5 mm to 5.0 mm, more preferably from 0.8 mm to 4.0 mm, even more preferably from 1.0 mm to 3.0 mm.

Said applicator (1) comprises at least one metering layer, wherein said metering layer is selected from the group consisting of non-wovens, foams and combinations thereof.

Said at least one metering layer may be a first metering layer (50). Said first metering layer (50) is laid upon said rim (222) of said well (202) of said well (20).

Said at least one metering layer may also be a second metering layer (60). Said second metering layer (60) is laid upon said internal surface (101) of said plate (10), preferably along said perimeter (103) of said plate (10).

Preferably, said applicator (1) comprises a first (50) and a second (60) metering layers.

Said at least one metering layer has a compressibility as defined herein of from about 59% to about 93% and a calliper of from about 0.40 mm to about 21.88 mm. The ratio of said at least one metering layer calliper to said average distance (D1) is defined by equation (I); wherein the mathematical relationship (I) is $$4.375 \times D1 \geqq \text{Calliper (mm)} \geqq 0.792 \times D1 \quad \text{(I);}$$

The term calliper as used herein refers to the sum of total number of at least one metering layers present, wherein applicator (1) embodiments comprising a first (50) and second (60) metering layer the calliper is the sum of the callipers of said first (50) and second (60) metering layer.

The term compressibility as used herein refers to each metering layer present. Thus in embodiments comprising a first (50) and second (60) metering layer, each of these first (50) and second (60) layers must meet the compressibility requirement.

A first metering layer (50) and/or a second metering layer (60) as described herein enable said applicator (1) to perform an application of a hair treatment composition to a hair strand, not only in a clean and non-messy fashion, but also evenly as demonstrated herein below.

1. Applicator

The applicator (1) according to the present invention comprises a plate (10) movably joined to a well (20). Said plate (10) and said well (20) of said applicator (1) according to the invention are of ergonomic size and can thus fit easily on either hand. The shape of said plate (10) may vary. Rectangular, square, circular, elliptical, oblong shape or combination thereof may be useful as they are easy to manufacture but other shapes, particularly those that are easily recognized by the consumers may also be used.

Said plate (10) of said applicator (1) comprises an axis Y. Axis Y extends straight from the centre of said plate (10) and transversally crosses said connection (30), preferably perpendicular.

Said plate (10) comprises a perimeter (103), an internal surface (101) and an external surface (102). Said well (20) comprises a bottom (201), a wall (202) and said wall (202) comprises a rim (222). Said rim (222) defines an opening (203) and an internal volume (204) of said well (20). Said internal volume (204) is preferably for containing a hair treatment composition.

Preferably, said perimeter (103) of said plate (10) and said rim (222) of said wall (202) of said well (20) may be curvilinear or sharp. Said perimeter (103) of said plate (10) and said rim (222) of said well (202) of said wall (20) have each independently a length. Preferably, said perimeter (103) and said rim (222), have substantially identical lengths. Said rim (222) also comprises a width. Preferably, said width of said rim (222) is from about 1 mm to about 20 mm, more preferably from about 2 mm to about 15 mm, even more preferably from about 3 mm to about 8 mm.

Said internal surface (101), said external surface (102) of said plate (10) as well as said bottom (201) and said wall (202) of said well (20) may further comprise one or more areas, which have visible and/or tactile differences from said internal surface (101) and/or from said external surface (102) and/or from said bottom (201) and/or from said wall (202). Said visible or tactile differences comprise differences in colour and/or shade, differences in patterns, markings and/or embossments. Those visible or tactile differences, differences in colour and/or shade, differences in patterns, markings and/or embossments, in particular those present into the well (20) may be provided to indicate where and how much hair treatment composition should be loaded into said well (20).

Figure 2A:
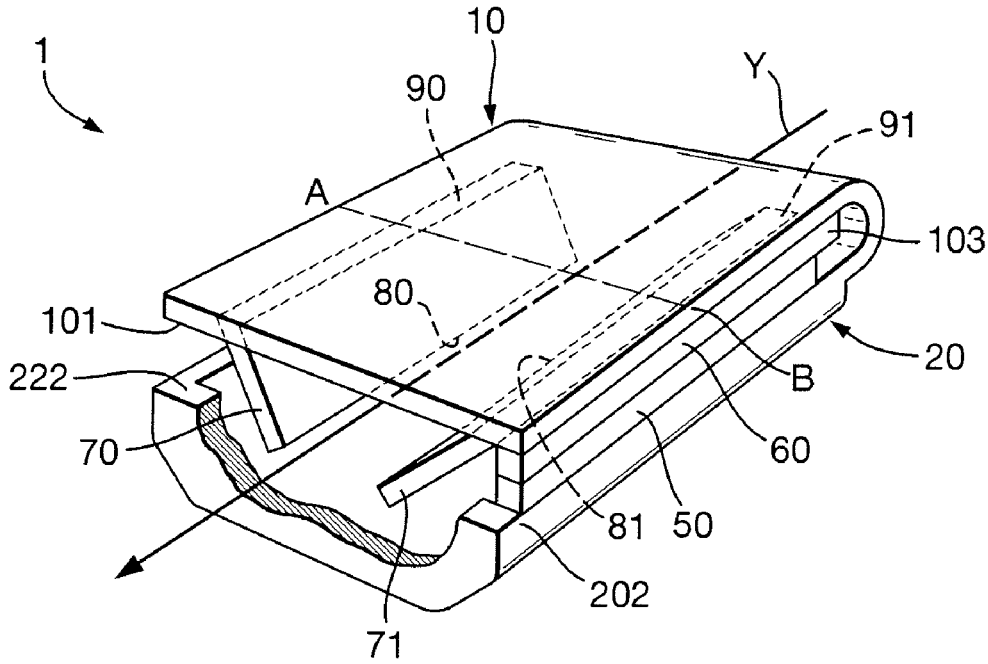
FIG. 2A is a perspective view of an embodiment of the applicator (1) according to the invention. The applicator (1) is shown in this embodiment in a closed state. Part of said wall (202) of said well (20) has been removed to show that from said internal surface (101) of said plate (10), which in this embodiment is substantially flat, two substantially identical first fin (70) and second fin (71) project in a way that said proximal edges (90; 91) are substantially parallel to said axis Y and said distal edges (80; 81) verge one toward the other. A first metering layer (50) is laid upon said rim (222) of said wall (202) and a second metering layer (60) is laid upon said substantially flat internal surface (101), along said perimeter (103) of said plate (10).
Figure 5A:
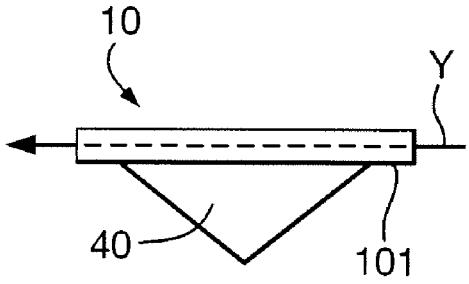
FIGS. 5A, 5B and 5C are cross-sectional views of said plate (10) of said applicator (1) according to the invention. The cross-sectional views are taken at the centre of said plate (10) along axis Y. One or more dipping means project from said internal surface (101) of said plate (10). Said one or more dipping means are.
Figure 5B:
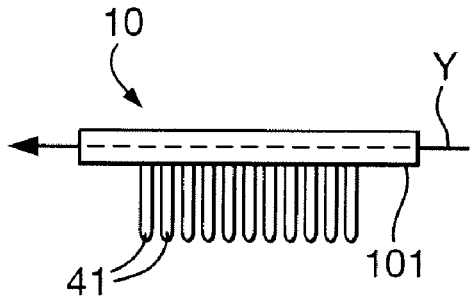
Figure 5C:
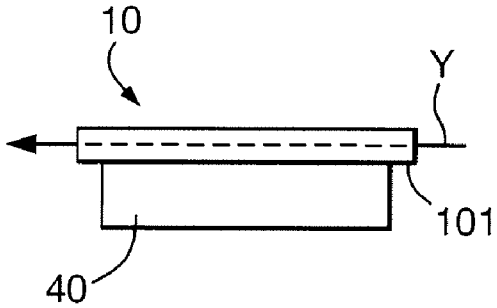
Figure 5D:
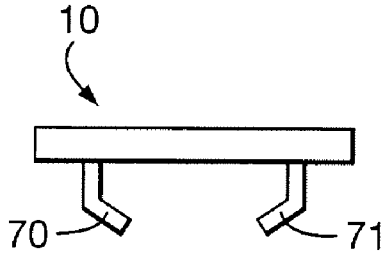
FIGS. 5D, 5E, 5F and 5G are cross-sectional views of a plate (10) of an embodiment of said applicator (1) according to the invention. The cross-sectional views are taken transversally to said axis Y (not shown herein) and substantially at the centre of said plate (10). Each view shows a plate (10) comprising a first (70) and a second (71) fin, wherein said fins (70; 71) have different shapes.
Figure 5E:
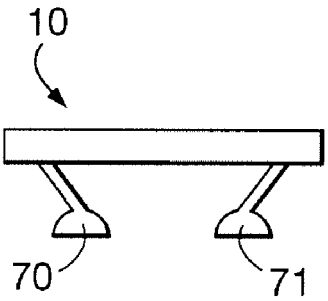
Figure 5F:
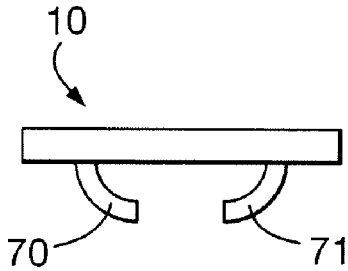
Figure 5G:
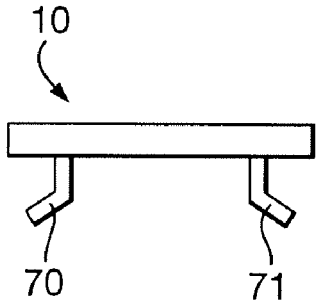
Figure 5H:
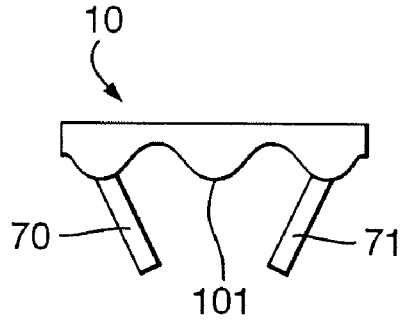
FIGS. 5H, 5L and 5M are cross-sectional views of a plate (10) of an embodiment of said applicator (1) according to the invention. The cross-sectional views are taken transversally to said axis Y (not shown herein) and substantially at the centre of said plate (10). Each view shows a plate (10) comprising a first (70) and a second (71) fin, wherein each of said fins (70; 71) has a substantially rectangular shape. Said internal surface (101) of said plate (10) is.
Figure 5L:
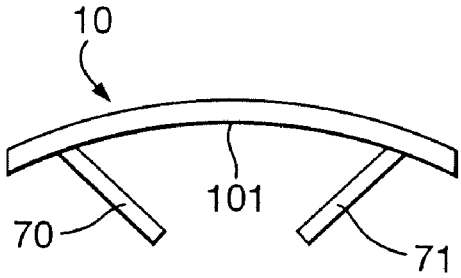
Figure 5M:
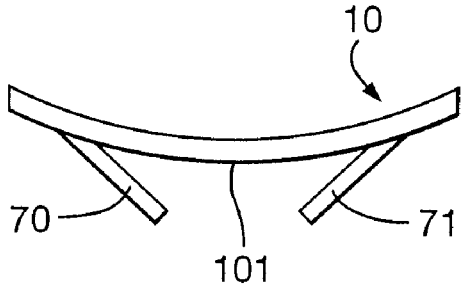
Figure 5M:
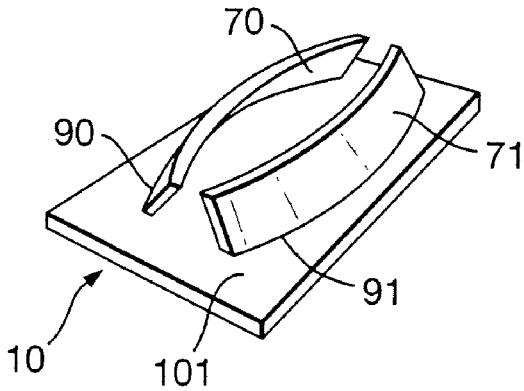

Said internal surface (101) of said plate (10) may be substantially flat as shown in FIG. 2A or may be concave as shown in FIG. 5L or may be convex as shown in FIG. 5M. In addition said internal surface (101) may have a waved pattern as shown in FIG. 5H. Preferably said internal surface (101) of said plate (10) is substantially flat. When said internal surface (101) is substantially flat, it preferably has a surface area of from about 2 $cm^2$ to 150 $cm^2$ preferably about 2 $cm^2$ to about 70 $cm^2$, more preferably from about 3 $cm^2$ to about 50 $cm^2$, even more preferably from about 4 $cm^2$ to about 30 $cm^2$.

Said external surface (102), said wall (202) and said bottom (201) may also be substantially flat, concave, convex or waved. Preferably, said bottom (201) of said well (20) is substantially flat.

Said plate (10) and said well (20) may be manufactured from any known material or combination of materials capable of supporting a hair treatment composition. Suitable materials are polymer resins such as a polyolefins e.g. polypropylene, polyethylene or polyethylene terephthalate. Other materials which could be used include polyvinylchloride, polyamide, acetyl, acrylonitrile butadiene styrene, acrylic, acrylonitrile styrene acrylate, ethylene vinyl alcohol, polycarbonate, polystyrene, silicone or thermo plastic elastomer, thermo plastic vulcanate or copolymers where appropriate; flexible pliable substrates such as paper boards, metal based substrates and aluminium foils, filmic substrates or multiple laminations or combinations of multiple layers of said materials.

The method of manufacture of said plate (10) and said well (20) may include, but is not limited to, injection moulding, co-injection moulding, over moulding, in-mold assembly, compression moulding, blow moulding, thermo or vacuum forming of a blister type shell and lamination onto a carrier plastic or board material in the horizontal or vertical plane.

A connection (30) movably joins said plate (10) and said well (20). A connection (30) is necessary to improve the user's perception of control over the applicator (1) and to allow the user to guide the applicator (1), with the use of either hand, precisely and easily to each bundle of hair strands. In addition, the connection (30) allows the user to move said applicator (1) from one bundle of hair strands to another without having to adjust the position of said plate (10) onto said well (20) after each application.

Said plate (10) and said well (20) being movably joined by a connection (30), it is possible for said applicator (1) to alternate from an open state to a closed state. Said applicator (1) is shown in FIG. 2A in a closed state. When said device (10) is in a closed state, said internal surface (101) of said plate (10) is in a juxtaposed relationship to said opening (203) of said well (20). When said applicator (1) is in a closed state, said perimeter (103) of said plate (10) has an average distance (D1) from said rim (222) of said wall (20) of said well (20). Said average distance (D1) is preferably from about 0.5 mm to about 5.0 mm, more preferably from about 0.8 mm to about 4.0 mm, even more preferably from about 1.0 mm to about 3.0 mm. The average distance (D1) was determined using a Mitutoyo Digimatic callipers as described hereafter.

To alternate from an open state to a closed state, said plate (10) and said well (20) may pivot about said connection (30). In one embodiment, the applicator (1) is in an open state and the user applies pressure on said external surface (102) of said plate (10) and on said bottom (201) of said well (20) to bring the device (10) in a closed state. To move said plate (10) and said well (20) back from a close state to an open state either said external surface (102) of said plate (10) and said well (10) may be independently provided with one or more fitting means for the user's fingers or the connection (30) itself may re-establish the initial orientation of said plate (10) and said well (20), preferably by springing back. The spring back property should preferably not occur uncontrollably and unexpectedly as it may otherwise injure the user's hand and fingers. Uncontrolled spring back may displace inadvertently the hair treatment composition from the applicator (1) causing messiness. The connection (30) should work preferably with applicable pressures suitable for use by most consumers.

The characteristics of said connection (30) may be an intrinsic property of the material used to manufacture said connection (30) or may be provided by the design of said connection (30) itself. Said connection (30) should preferably not break or get damaged so as to affect utility within a few applications. Said connection (30) should preferably not be too resistant to the applied pressure by the user, otherwise the user's hand and fingers may ache during repetitive use. Said connection (30) should also not be too weak or provide little or no perception of guidance over the applicator (1).

Said plate (10) and said well (20) are connected via any suitable means that fulfils the above described requirements for a connection (30), including the user's hand, for example through the thumb and index finger. In one embodiment, said plate (10) and said well (20) are mounted at the ends of the arms of a tweezers-like or tong-like connection (30). In another embodiment said plate (10) and said well (20) are connected via one or more hinges, preferably one hinge. Preferably, said connection (30) is contiguous and located adjacent to said perimeter (103) of said plate (10) and to said rim (222) of said well (20). Said one or more hinges can be formed in a number of ways including: a "live" injection moulded hinge, a co-injected hinge, an over moulded hinge, in-mold assembly, a leaf spring or any other appropriate spring assembly, a strap hinge, a fold formed by a kiss-cut, score or crease.

In certain embodiments, both said plate (10) and said well (20) may be manufactured within the same injection mould for example from polypropylene. A living hinge also made from polypropylene may be created between said plate (10) and said well (20). Polypropylene may be used to provide a living hinge that can be flexed multiple times without breakage. The living hinge is typically closed during the de-moulding process.

In certain embodiments, both said plate (10) and said well (20) may be manufactured within the same injection mould for example from polypropylene and a hinge can be created by co-injection, in-mold assembly or over-moulding of a thermo plastic elastomer or a thermo plastic vulcanate or any other material that can be used to provide a hinge with the properties listed above.

To apply a hair treatment composition to a hair strand, preferably to a bundle of hair strands, with an applicator (1) as described herein, said hair strand is contacted with said applicator (1). Preferably, said hair strand is located between said plate (10) and said well (20) while said applicator (1) is in an open state. Said internal surface (101) of said plate (10) is brought into a juxtaposed relationship to said opening (203) of said well (20) and said applicator (1) is swiped along the length of said hair strand.

Preferably at least one dipping means as described herein projects from said internal surface (101) of said plate (10). When at least one dipping means is present, said hair strand is bent within said well (20). Without wishing to be bound by theory it is believed that by having at least one dipping means enables said hair strand, preferably said bundle of hair strands, to contact said hair treatment composition within said internal volume (204) of said well (20) and not only at said opening (203) of said well (20). This improves the evenness of the application, in particular, the rear and front evenness as described herein after.

Figure 3:
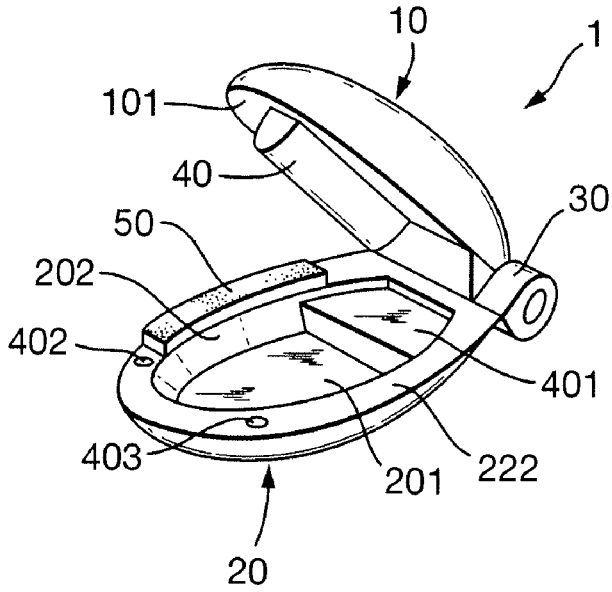
FIG. 3 is a perspective view of an embodiment of said applicator (1) according to the invention. Said plate (10) is movably joined to said well (20) by a connection (30). A member (40), which has a substantially pyramidal frustum form, projects from said internal surface (101) of said plate (10). On said rim (222) a first metering layer (50) and two stop mechanisms, here represented by two substantially identical hemispheres (402; 403), are shown. On the bottom (201) of said well (20) adjacent to said wall (202) at the side of the connection (30) said applicator (1) comprises a sealing means (401).

In one embodiment of the present invention, said at least one dipping means is a member (40), which projects from said internal surface (101) of said plate (10), wherein said member (40) has preferably a substantially pyramidal frustum form, as shown in FIG. 3. Said member (40) may have various forms including, but not limited to, a parallelepiped form, a cube form, a cylinder form, a conical or a pyramidal form as shown in FIG. 5A. Said member may have a substantially parallelepiped form as shown in FIG. 5C. Said member (40) may also be composed of a plurality of independent units grouped together; said independent units may comprise bristles, teeth or tines (41) as shown in FIG. 5B. Said member (40) has preferably a substantially pyramidal frustum form as shown in FIG. 3. In another embodiment not show herein, said member (40) comprises a cylinder which is rotary engaged via its circular bases to said internal surface (101) via two pins, emerging from said internal surface (101) of said plate (10).

Said member (40) projects from said internal surface (101) of said plate (10) with a maximum height (H) and extends along said internal surface (101) with a maximum width (W)

and a maximum length (L). Said member (40), preferably projects orthogonally to said axis Y with said maximum height (H). Said member (40) may extend along said internal surface (101) of said plate (10) with its maximum length (L) either along said axis Y or substantially parallel to said axis Y or transversally to said axis Y.

Preferably, said maximum length (L) is at least twice said maximum width (W). The maximum length (L) is preferably from about 20.0 cm to about 0.2 cm, more preferably from about 15.0 cm to about 0.3 cm, even more preferably from about 10.0 cm to about 0.5 cm. The maximum width (W) is preferably from about 2.5 cm to about 0.01 cm, more preferably from about 1.0 cm to about 0.02 cm, even more preferably from about 0.5 cm to about 0.03 cm. The maximum height (H) is preferably from about 5.0 cm to about 0.1 cm, more preferably from about 2.5 cm to about 0.2 cm, even more preferably from about 1.5 cm to about 0.3 cm.

When said applicator (1) is in a closed state, said member (40) does not contact said bottom (201) of said well (20), so that a passage is left and said hair strand, preferably said bundle of hair strands, is not constrained.

Said member (40) may be manufactured dependently or independently from said applicator (1) from any known material or combinations of materials capable of supporting a hair treatment composition. Suitable materials are polymer resins such as a polyolefin e.g. polypropylene, polyethylene or polyethylene terephthalate. Other materials which could be used include polyvinylchloride, polyamide, acetyl, acrylonitrile butadiene styrene, acrylic, acrylonitrile styrene acrylate, ethylene vinyl alcohol, polycarbonate, polystyrene, silicone or thermo plastic elastomer, thermo plastic vulcanate or copolymers where appropriate; flexible pliable materials such as metal based substrates and aluminium foils, filmic substrates or multiple laminations or combinations of multiple layers of said materials.

The method of manufacture of said member (40) may include, but is not limited to, injection moulding, co-injection moulding, over moulding, in-mold assembly, compression molding, blow moulding, thermo or vacuum forming.

When said member (40) is independently manufactured from said applicator (1), said member (40) may be attached by any suitable method to the internal surface (101) of said plate (10). Useful methods are, but not limited to, heat welding including pressure, ultrasonic forces, radio or high frequencies, co-extruded heat activated adhesives. Said member (40) may also be attached to said applicator (1) through adhesive, including double sided tape, thermo-set, hot melt and cold seal, adhesion or extrusion lamination. Mechanical interlock or entanglement such as Velcro®, clamping, snap locks, sealing beads, locking pins and magnetism may also be used to adhere said member (40) to said applicator (1).

In another embodiment according to the invention said at least one dipping means comprises a first fin (70). Preferably, said at least one dipping means comprises a first (70) and a second fin (71), which independently project from said internal surface (101) of said plate (10) as shown in FIG. 2A. The term "fin" within the scope of the present invention defines a strip or sheet of material, preferably of substantially constant thickness as described below. The form of said first (70) and/or second (71) fin may vary; preferably said first (70) and/or second (71) fin have the form of a parallelepiped wherein two of the six faces extend for an area which is at least twice the area of the other four faces. Those two faces have preferably a substantially flat surface. The shape of said first (70) and second (71) fin may vary. Rectangular, square, circular, elliptical, oblong or combination thereof may be useful. A rectangular shape as shown in FIG. 2A is preferred. Other shapes and forms of said first and second fins (70; 71) may be used to bend said hair strand within said internal volume (204) of said well (20). Some examples are given in FIGS. 5D, 5E, 5F and 5G.

Figure 2B:
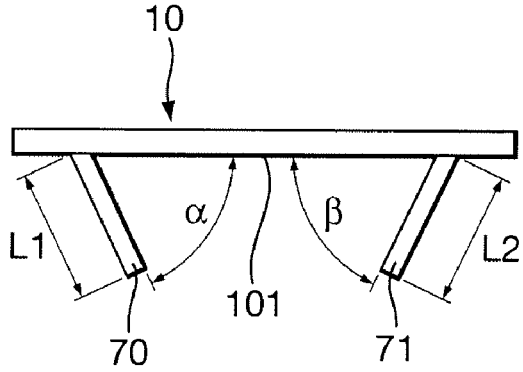
FIG. 2B is a cross-section of said plate (10) shown in FIG. 2A. The cross-section is taken perpendicular to said axis Y, along line AB in FIG. 2A. Said two substantially identical first and second fins (70; 71) extend for substantially identical average first and second lengths (L1; L2) and form with said substantially flat internal surface (101) substantially identical angles $\alpha$ and $\beta$.
Figure 2C:
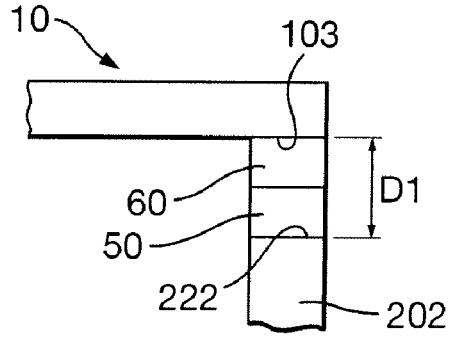
FIG. 2C is the same cross-section as shown in FIG. 2B but evidencing said average distance (D1) between said perimeter (103) of said plate (10) and said rim (222) of said wall (202). Said first metering layer (50) and said second metering layer (60) are also shown.

Said first fin (70) projects from said internal surface (101) of said plate (10) and extends for an average first length (L1) of from about 2 mm to about 30 mm. Said first fin (70) forms with said internal surface (101) of said plate (10) and angle $\alpha$ of from about 15° to about 75°. Preferably, when said internal surface (101) of said plate (10) is substantially flat as shown in FIGS. 2A and 2B said angle $\alpha$ is from about 25° to about 55°, more preferably from about 35° to about 55° and even more preferably from about 35° to about 50°. Preferably, a second fin (71) projects from said internal surface (101) of said plate (10) independently from said first fin (70), as shown in FIGS. 2A and 2B, and wherein said second fin (71) forms independently from said first fin (70) an angle $\beta$ of from 1° to 90°. Said second fin (71) extends independently from said first fin (70) for an average second length (L2) of from about 2 mm to about 30 mm. Preferably, when said internal surface (101) of said plate (10) is substantially flat, said angle $\beta$ is from about 25° to about 55°, more preferably from about 35°to about 55° and even more preferably from about 35° to about 50°. More preferably, said internal surface (101) of said plate (10) is substantially flat and said first (70) and second fin (71) form with said substantially flat internal surface (101) substantially identical angles $\alpha$ and $\beta$ of from about 25° to about 55°. Preferably said first (70) fin and said second (71) fins project independently from said internal surface (101) of said plate (10) and extend with substantially identical average first and second lengths (L1; L2).

Figure 5P:
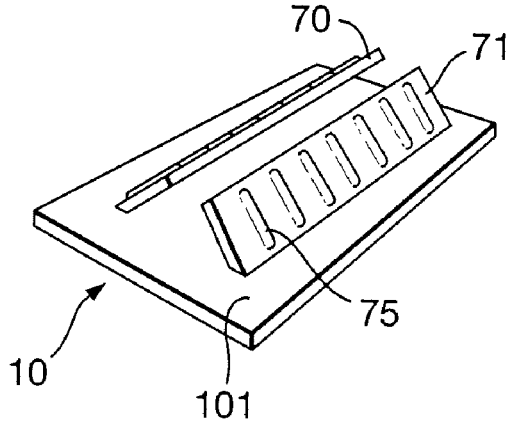

Each of said first (70) and second (71) fin has a distal edge (80; 81) and a proximal edge (90; 91). Said proximal edge (90; 91) are those attached to said internal surface (101) of said plate (10) as shown in FIG. 2A. Said proximal edges (90; 91) are each independently delimited by an average width (W1) for said first fin (70) and an average width (W2) for second fin (71) and each independently by average thickness (T1) for said first fin (70) and an average thickness (T2) for said second fin (71). Said average width (W1) and (W2) are preferably of from about 20 cm to about 0.5 cm, more preferably from about 15 cm to about 1.0 cm and even more preferably from about 10 cm to about 1.5 cm. Said average thicknesses (T1) and (T2) are preferably from about 5 mm to about 0.1 mm, more preferably from about 4 mm to about 0.5 mm, even more preferably from about 3 mm to about 0.5 mm. Preferably, said distal edges (80; 81) have also substantially identical average widths (W1) and (W2) and substantially identical average thicknesses (T1) and (T2) as those proximal edges (90; 91). Said first and second fins (70; 71) may have protrusions (75) as shown in FIG. 5P or may be embossed, especially to provide visual or tactile decoration. Preferably said first and second fins (70; 71) have constant thicknesses.

Said first and second fin (70; 71) may project from said internal surface (101) of said plate (10) in any orientation one with respect to the other. In one embodiment said first and second fins (70; 71) and their proximal edges (90; 91) are curved as shown in FIG. 5N. Preferably, said first (70) and second (71) fin project from said internal surface (101) so that said proximal edge (90) of said first fin (70) is substantially parallel to said proximal edge (91) of said second fin (71) as shown in FIG. 2A. Preferably said proximal edge (90) of said first fin (71), more preferably said proximal edge (90) of said first fin (71) and said proximal edge (91) of said second fin (71) project from said internal surface (121) parallel to said axis Y of said plate (120) as shown in FIGS. 2A and 2B.

When said applicator (1) comprises a first and a second fin (70; 71) and irrespectively whether said proximal edges (90; 91) of said first and second fin (70; 71) project independently from said internal surface (101) of said plate (10) in a parallel fashion, said distal edge (80) of said first fin (70) and said distal edge (81) of said second fin (71) may verge one toward another as shown in FIG. 2B, may diverge toward opposite direction or they may point toward the same direction without verging.

In one embodiment of said applicator (1) according to the invention, said applicator (1) comprises a first fin (70) and a second fin (71), said first and second (70; 71) extend independently for substantially identical average lengths (L1) and (L2), said internal surface (101) of said plate (10) is substantially flat and said first fin (70) and said second fin (71) form with said substantially flat internal surface (121) substantially identical angles $\alpha$ and $\beta$ of from about 25° to about 55°, said proximal edge (90) of said first fin (71) and said proximal edge (91) of said second fin (71) project from said substantially flat internal surface (101) parallel to said axis Y of said plate (10) and said distal edges (80; 81) verge one toward the other as shown in FIG. 2A.

Said first and second fin (70; 71) may be provided in a variety of materials and be manufactured independently of said applicator (1). Examples of materials useful for said first (70) and second (71) fin include, but are not limited to, a polymer resin such as a polyolefin e.g. polypropylene, polyethylene or polyethylene terephthalate. Other materials could be used including polyvinylchloride, polyamide, acetyl, acrylonitrile butadiene styrene, acrylic, acrylonitrile styrene acrylate, ethylene vinyl alcohol, polycarbonate, cellulose acetate, polychloropene, ethylene vinyl acetate, polychlorotrifluoroethylene, polyphenylene oxide, polysulfone, polyurethane, polytetrafluoroethylene, polyvinyl acetate or polystyrene, natural rubber, latex, nylon, nitrile, silicone, polyurethane or thermo plastic elastomer or copolymers where appropriate or foams or a flexible pliable substrate such as paper, board, metal based substrates and aluminium foil, filmic substrates or multiple laminations or combinations of multiple layers of said materials.

In certain embodiments, both the said first (70) and second (71) fin and said plate (10) may be manufactured within the same injection or co-injection mould for example from polypropylene, acrylonitrile butadiene styrene, acrylic, acrylonitrile styrene acrylate, ethylene vinyl alcohol, polycarbonate, polystyrene, silicone or thermo plastic elastomer.

The method of manufacture of said first (70) and second (71) fin may be independent from said applicator (1). Useful manufacturing processes may include, but not limited to, injection moulding, co-injection moulding, over moulding, in-mold assembly, compression molding, blow moulding, thermo or vacuum forming. When the said first (70) and second (71) fin are independently manufactured from said applicator (1), said first (70) and second (71) fin may be attached by any suitable method to the internal surface (101) of said plates (10). Useful methods are, but not limited to, heat welding including pressure, ultrasonic forces, radio or high frequencies, co-extruded heat activated adhesives. Said first (70) and second (71) fin may also be attached to said applicator (1) through adhesive, including double sided tape, thermo-set, hot melt and cold seal, adhesion or extrusion lamination. Mechanical interlock or entanglement such as Velcro®, clamping, snap locks, sealing beads, locking pins and magnetism may also be used to adhere the said first (70) and second (71) fin to said applicator (1).

2. Metering Layers

The applicator (1) according to the present invention is characterized by at least one metering layer (50) as described herein. Said at least one metering layer is selected from a group consisting of non-wovens, foams and combinations thereof. Said at least one metering layer may be a first metering layer (50) laid upon said rim (222) of said well (20). Said at least one metering layer may also be a second metering layer (60). Said second metering layer (60) is laid upon said internal surface (101), more preferably along said perimeter (103) of said plate (10). Preferably, said applicator (1) comprises a first (50) and a second (60) metering layers.

Without wishing to be bound by theory, it is believed that by having at least one metering layer, as described herein, as first metering layer (50) laid upon said rim (222) of said well (20) and/or as second metering layer (60) laid upon said internal surface (101) of said plate (10), preferably along said perimeter (103), allows said applicator (1) according to the invention not only to apply the hair treatment composition, but to even said application along the entire hair strand. Evenness is an important key in the application of a hair treatment composition, especially when said hair treatment composition is a highlighting composition or a dyeing composition. The permanent effect provided by those compositions is not immediately visible after the application and if the result is not appealing, it is not easily reversed. An applicator should hence ensure homogeneous application along the entire length and width of said bundle of hair strands and likewise on the front and rear surfaces. The application of a hair treatment composition may be relatively easy on accessible sectors of the head, such as on bundles of hair strands around the face, but it is a challenge for applications at the back of the head. Therefore, it is not only the amount of hair treatment composition which is applied that is important but also the way it is applied. The applicator (1) according to the invention is not only designed to facilitate the application of a hair treatment composition to a hair strand, preferably to a bundle of hair strands. Said applicator (1) also avoids that said hair treatment composition just applied is neither applied in excessive amount nor removed from said hair strand while the applicator (1) is used, so to obtain a very homogeneous and reproducible application.

The present inventors have surprisingly found that preferably the purpose of first said (50) and second (60) metering layer according to the present invention is fulfilled by a group of non-wovens, foams or combinations thereof having a specific calliper and compressibility, as defined herein.

The calliper measures the thickness of said at least one metering layer and determines whether said at least one metering layer interacts with the hair strand or not. The term calliper as used herein refers to the sum of the callipers for the total number of at least one metering layers present. Thus in embodiments comprising a first (50) and a second (60) metering layer the calliper is the sum of the calliper of the first (50) and second (60) metering layers. Each of said first (50) and second (60) metering layer has independently a calliper, wherein the sum of said callipers of said first (50) and second (60) metering layers is from about 0.40 mm to about 21.88 mm, preferably from about 0.63 mm to about 17.50 mm and even more preferably from about 0.79 mm to about 13.13 mm. A first metering layer (50) is laid upon said rim (222) of said well (20) and/or a second metering layer (60) is laid upon said internal surface (101) of said plate (10). When said internal surface (101) of said plate (10) is brought into a juxtaposed relationship to said opening (203) of said well (20), said perimeter (103) of said plate (10) has an average distance (D1) to said rim (222) of said well (20). The ratio of said at least one metering calliper (which is the sum of the independent callipers of said first meter layer (50) and/or a second metering layer (60)) to said average distance (D1) is defined by the mathematical relationship (I) wherein:

$$4.375 \times D1 \geqq \text{Calliper (mm)} \geqq 0.792 \times D1 \quad \text{(I)}$$

Without wishing to be bound by theory, it is believed that this ratio of calliper to average distance (D1) as defined above, allows said hair strand to fit between the plate (10) and the well (20). In addition, once the hair strand has received said hair treatment composition while passing in the well (20), said at least one metering layer avoids said hair treatment composition to be scraped off from said hair strand.

The capability of said hair strand to fit between said plate (10) and said well (20) is not only related to the calliper of said first (50) and/or second (60) metering layer but also to the ability of those specific metering layers to compress under a specific force and for a defined time range.

Without wishing to be bound by theory, it is believed that only metering layers having a specific compressibility as defined herein below allow the application of a hair treatment composition, with an applicator (1) according to the invention, to a hair strand in an even fashion avoiding scraping off or wiping away the just applied hair treatment composition.

Each of said first (50) and second (60) metering layers has independently a compressibility at about 0.5 kPa of from about 59% to about 93%. Said compressibility is preferably from about 60% to about 85%, more preferably from about 60% to about 77%.

Said first metering layer (50) and said second metering layer (60) preferably have a substantially identical calliper and/or substantially identical compressibility as defined herein.

Said first metering layer (50) is laid upon said rim (222) of said wall (202) of said well (20). Said first metering layer (50) may be laid upon said rim (222) in a continuous or discontinuous manner. By discontinuous is meant that said metering layer may form loci or islets or may be interrupted.

In one embodiment, said first metering layer (50) is laid upon the entire rim (222) of said wall (202) so that said rim (222) is not visible and entirely covered by said first metering layer (50). In another embodiment, said first metering layer (50) is laid upon only a portion of said rim (222), for example only a portion of said length of said rim (222) may comprise said first metering layer (50) as shown in FIG. 2A.

When said applicator (1) according to the invention comprises a dipping means, said first metering layer (50) is laid upon said rim (222) to be in correspondence to said dipping means as explained herein below. When said applicator (1) comprises a dipping means, for example a member (40) as shown in FIG. 3, said member (40) extends along said internal surface (101) with a maximum length (L). The application of a hair treatment composition with an applicator (1) according to the invention is performed by locating said hair strand between said plate (10) and said well (20) and preferably said hair strand is located substantially transversal to said maximum length (L) of said member (40). To achieve a even application, said first metering layer (50) is preferably laid upon a portion of said rim (222) which is substantially parallel to said maximum length (L) of said member (40) when said applicator is in a closed state.

In another embodiment of the present invention as shown in FIG. 2A, said dipping means comprises a first and a second fin (70; 71). Said proximal edges (90; 91) of said first and second fins (70; 71) are substantially parallel to said axis Y of said plate (10). In this embodiment said first metering layer (50) is preferably laid upon a portion of said rim (222) which is substantially parallel to said proximal edges (90; 91) of said fins (70; 71) when said applicator (1) is in a closed state.

Figure 4:
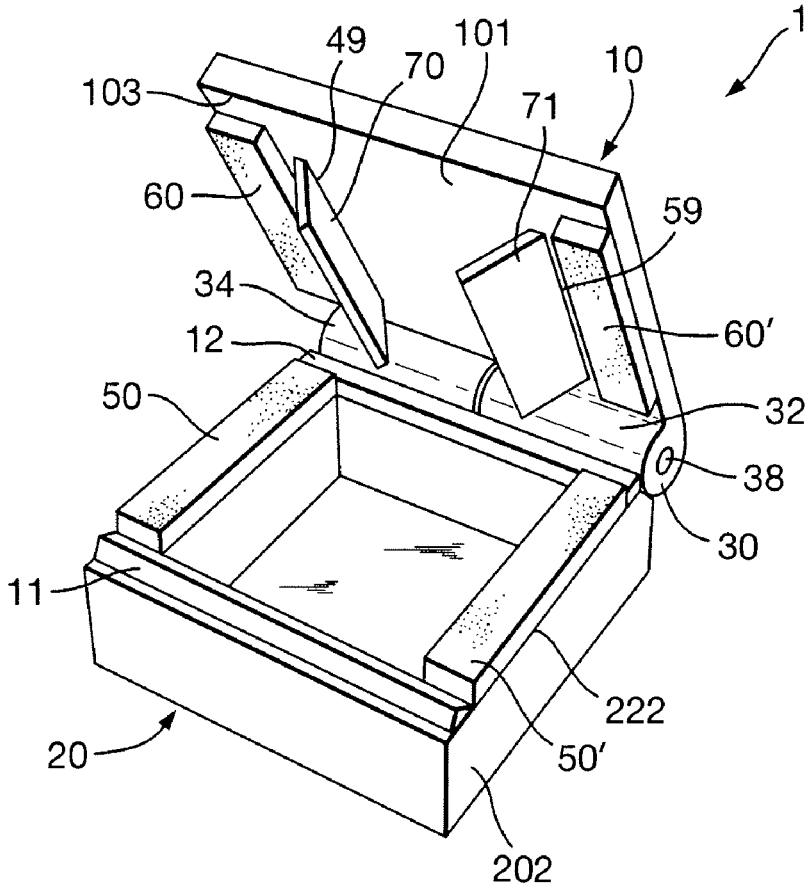
FIG. 4 is a perspective view of an embodiment of an applicator (1) according to the invention. Said applicator (1) comprises a plate (10) connected by a connection (30) to a well (20). Said connection (30) comprises two female parts (32; 34) fixed by a pin (38). Two strips (11; 12) are placed on said rim (222) of said wall (202) of said well (20). A first metering layer is laid upon said rim (222) in two pieces (50; 50'). A second metering layer is laid upon said internal surface (101) along said perimeter (103) in two pieces (60; 60'). Two substantially identical slots (49; 59) are cut through said plate (10) to accommodate two substantially identical (70; 71) fins.

Clearly, for both the embodiments discussed above, said first metering layer may be discontinuous (50; 50') and laid upon said rim (222) of said wall (222) on both sides parallel to said maximum length (L) of said member (40) or of said distal edges (90; 91) of said first and second fins (70; 71), as shown in FIG. 4.

Preferably, when an applicator (1) according to the invention comprises a sealing means (401) as described below, on said rim (222) of said well (202), said first metering layer is laid upon said rim (222) adjacently to said sealing means (401) either touching said sealing means (401) or not.

When said applicator (1) according to the invention comprises a second metering layer (60), said second metering layer (60) is laid upon said internal surface (101) of said plate (10), more preferably along said perimeter (103) of said plate (10). As described above for said first metering layer (50), also said second metering layer (60) may be laid upon said internal surface (101) of said plate (10) in a continuous or discontinuous manner.

In one embodiment said second metering layer (60) may be laid upon said entire internal surface (101) of said plate (10). If a dipping means is present, said second metering layer (60) may be laid upon said dipping means, preferably, said second metering layer (60) is not laid upon said dipping means.

In another embodiment said second metering layer (60) is laid upon only a portion of said internal surface (101), preferably along said perimeter (103) of said plate (10).

When said applicator (1) comprises a first metering layer (50), preferably said second metering layer (60) is laid upon said internal surface (101) of said plate (10) so that when said internal surface (101) said plate (10) is brought into a juxtaposed relationship to said opening (203) of said well (20), said second metering layer (60) is juxtaposed to said first metering layer (50) as shown in FIG. 2A.

Said first and second metering layers (50; 60) may independently have a length of from about 3 mm to about 40 cm, preferably from about 5 mm to about 10 cm, more preferably from about 8 mm to about 5 cm.

Said first and second metering layers (50; 60) may independently have a constant or variable width along said lengths. Said first and second (50; 60) metering layers may independently have a width of from about 1 mm to about 20 mm, preferably from about 2 mm to about 15 mm, more preferably from about 3 mm to about 8 mm.

Preferably, said first and second metering layers (50; 60) have substantially identical widths and substantially identical lengths and they are laid upon said rim (222) and said internal surface (101) along said perimeter (103), respectively, so that when said plate (10) is brought into a juxtaposed relationship to said opening (203) of said well (20), said second metering layer (60) is substantially a mirror image of said first metering layer (50). Even more preferably said first and second metering layer (50; 60) have substantially identical and constant widths, lengths and callipers.

Said first (50) and second (60) metering layers are selected from the group consisting of non-wovens, foams and combinations thereof.

Suitable non-wovens may be comprised of natural or synthetic fibers selected from acetate fibers; acrylic fibers; cellulose ester fibers; modacrylic fibers; polyamide fibers; polyester fibers; polyolefin fibers; polyvinyl alcohol fibers; rayon fibers; polyethylene foam; keratin fibers; cellulose fibers; silk fibers and combinations thereof. The non-wovens may be comprised of mono-component fibers, such as a polyolefin or polyester, or bi-component fibers, such as a sheath/core fiber or side by side fiber of polyethylene/polypropylene or polyethylene/polyester, or bi-constituent fibers comprised by a blend of two or more thermoplastic polymers.

Examples of suitable Carded non-wovens include; PGI 214 and Libeltex 01-766 DI-4. Further examples of suitable non-wovens include USFELT F-50 and Ahlstrom 18008.

Foam materials are made from low density elastomers, plastics, and other materials with various porosities and may be selected from open cellular foams; flexible foams and reticular foams and syntactic foams which can be fabricated into finished shapes using molding, casting, extrusion, pultrusion, machining, thermal forming, plastic welding, blow molding, rapid prototyping techniques, grinding and/or other specialized processes. The foam materials may be composed of a variety of chemical systems including Acrylonitrile-Butadiene-Styrene, Acrylics; Epoxy resins; Fluoropolymers; isoprene-styrene and Styrene-Butadiene-Styrene; Synthetic rubbers or elastomers based on a variety of systems such as silicone, polyurethane, polyolefin and neoprene; Nitrile rubbers; plastics or elastomers formed from natural or plant-based raw materials such as natural rubber (polyisoprene) or vulcanized fibre; water-based and water-borne resins and latex materials. Chemical systems for foams may include ethylene copolymer, expanded polyethylene, polycarbonate, polyester, polyether, polyetherimide, polyimide, polyolefin, polypropylene, phenolic, polyurea, and vinyl. Examples of suitable foams include; Recticel Bulpren D32133; Recticel D27150 B and Recticel Bulpren S31048.

The metering layer of the present invention also include composite materials having one or more plies of the same or different materials superimposed physically, joined together continuously (laminated), in a discontinuous pattern, or by bonding the external edges at discrete loci. For such embodiments, the calliper of the metering layer is considered to be the calliper of the entire composite or multi-ply material.

Said first and second metering layer (50; 60) may be attached in any suitable method to said rim (222) and to said internal surface (101) of said plate (10), respectively, providing that said method does not destroy or alter the performance of said metering layers (50; 60). Useful methods are, but not limited to, heat welding including pressure, ultrasonic forces, radio or high frequencies, co-extruded heat activated adhesives, electro static adhesions such as flocking by fibres. Said metering layers (50; 60) may also be attached to the application device (1) through adhesive, including double sided tape, thermo-set, hot melt and cold seal, adhesion or extrusion lamination. Mechanical interlock or entanglement such as Velcro®, clamping, snap locks, sealing beads, locking pins and magnetism may also be used to adhere.

3. Experimental Data

The present inventors have surprisingly found that to achieve a satisfactory application of a hair treatment composition to a hair strand, said hair strand needs not only to come into contact with said hair treatment composition which has been loaded into said applicator (1), but also said hair treatment composition should be evenly applied onto said hair strand without being removed while the application occurs.

To apply a hair treatment composition with an applicator (1) to a hair strand, preferably to a bundle of hair strands, said hair strand is located substantially straight between said plate (10) and said well (20), where a hair treatment composition has been previously loaded. Preferably said plate (10) comprises a dipping means to bend said hair strand into said well (20).

Without wishing to be bound by theory, it is believed that when said applicator (1) comprises a first metering layer (50), preferably a first and a second metering layer (50; 60), as described herein, a hair treatment composition is evenly distributed from root to tip. Thus, if an excessive amount of said hair treatment composition is applied, said metering layers may distribute it evenly and homogeneously along the length of said hair strand but without removing it.

To demonstrate that only metering layers (50; 60) having the specific calliper, calliper to average distance (D1) ratio and compressibility as defined herein may provide the technical effect of the present invention, the following experimental data are provided.

A square plate (10), of dimensions of about 39 mm in length and width and about 3 mm in height, was manufactured in acrylic. A square well (20) was manufactured also in acrylic. The internal volume (204) of said well (20) had dimensions of about 29 mm in length and width and about 5 mm in height. Said wall (202) was about 5 mm in width so that said rim (222) was also about 5 mm in width. A connection (30) was created during the manufacturing process of said plate (10) and said well (20). Said connection (30) consisted of two female parts (32; 34), one at said perimeter (103) of said plate (10) and one at said rim (222) of said well (20) as shown in FIG. 4. The two female parts were fixed by a cylindrical pin (38) of diameter of about 2.5 mm and about 35 mm of length. A strip of acrylic (11) having dimension of about 39 mm in length, about 2.5 mm in width and about 2 mm in height was fixed on said rim (222) at the side of said connection (30) to act as sealing means. A second substantially identical strip (12) was glued on the rim (222) of said square well (20) on the opposite edge to said edge where said connection (30) was created as shown in FIG. 4, to act as a stop mechanism. When said internal surface (101) of said plate (10) is brought into a juxtaposed relationship to said opening (203) of said well (20); namely in a closed state said perimeter (103) of said plate (10) has an average distance (D1) of 2.0 mm to said rim (222) of said well (20).

On said plate (10) two slots (49; 59) were created at an angle of about 55° with said internal surface (101) of said plate (10) to accommodate two substantially identical fins (70; 71). Said slots (49; 59) were each of about 24 mm in length and about 1 mm in width. Each of said slots (49; 59) was located about 7 mm from said edge of said square plate (10) contiguous to said edge where the connection (30) was located and about 7.5 mm from the edge opposite to said edge where the connection (38) was located as shown in FIG. 4. Said slots (49; 59) were substantially parallel to one to the other and to said axis Y of said plate (10).

Two substantially identical fins (70; 71), manufactured in MCP Silicon Rubber RTC-1604, had a first and second average lengths (L1; L2) of about 7.3 mm, average widths (W1; W2) of about 24 mm and average thicknesses (T1; T2) of about 1 mm. Said first and second fins (70; 71) were slid into said slots (49; 59) so that said fins (70; 71) projected from said internal surface (101) as shown in FIG. 4. Said first and second fins (70; 71) were held in position by the mechanical fit into said slots (49; 59).

Different metering layers were tested using this applicator (1). Two strips of metering layers (50; 50') were located as shown in FIG. 4, between said stop mechanism (12) and said sealing means (11). Two additional strips of substantially identical dimensions of the same metering layer (60; 60') were attached by the same means to said internal surface (101) of said plate (10) along said perimeter (103). These two strips (60; 60') of second metering layer were located to be juxtaposed to said two strips (50; 50') of first metering layer, once the applicator (1) is brought into a closed state, in addition to be parallel to said first and second fins (70; 71).

While the applicator (1) above described was kept in an open state, said well (20) was loaded with about 2.0 grams of a pigmented hair treatment composition according to table 1 below.

TABLE 1

Pigmented hair treatment composition used to test applicator with different metering layers

| | % |
|---|---|
| Developer | |
| Deionized Water | 72.35 |
| Hydrogen Peroxide 50% | 18.0 |
| Cetearyl Alcohol (and) Ceteareth-20 | 1.5 |
| Glyceryl Stearate | 4.0 |
| Oleth-10 | 0.3 |
| Oleth-2 | 0.3 |
| Stearamidopropyl Dimethylamine | 0.6 |
| Etidronic Acid | 0.25 |
| Persulfate Powder | |
| Potassium Persulfate | 45.0 |
| Ammonium Persulfate | 10.0 |
| Sodium Silicate | 39.5 |
| Disodium EDTA | 1.0 |
| TiO2 | 3.5 |
| Ultramarine Blue (pigment) | 1.0 |

The pigmented hair treatment composition was prepared by mixing about 9.71 grams of persulfate powder with about 35.00 grams of developer in a bottle of about 100 ml. Mixing was performed by hand-shaking said bottle for about 30 seconds. The pigments were included to facilitate the visual assessment of the evenness of the application as explained below.

A bundle of hair strands, of about 0.30 grams in weight and about 30.5 cm in length (Caucasian Light Brown—International Hair Imports and Products, Valhalla, N.Y.) was placed substantially straight between said plate (10) and said well (20) and transversal to said strips (50; 50'; 60; 60') of metering layers. The internal surface (101) of said plate (10) was brought into a juxtaposed relationship to said opening (203) of said well (20) till said strip (12) acting as stop mechanism stopped the compression. As the substantially flat internal surface (101) of said plate (10) had the same extension of said opening (203) and rim (222) of said well (20), said plate completely and precisely covered said opening (203) and said rim (222) of said well (20). Said bundle of hair strands was bent within said well (20) where the hair treatment composition had been loaded. While keeping said square plate (10) and said square well (20) on the bundle of hair strands, the entire length of the bundle of hair strands was swiped taking 3 seconds for the swipe. The weight of the bundle of hair strands was recorded. The same experiment was repeated three times, the results averaged and indicated in FIG. 6 as average on-hair dosage of pigmented hair treatment composition deposited in grams per gram of hair. In addition the average evenness of the application was also reported.

The evenness of the application was visually assessed for root-to-tip (along length of hair bundle); center-to-edge (across hair bundle width) and front-to-back (both sides of hair bundle) using a 1 to 5 rating scale (1 being poor evenness). These ratings were combined to provide an average evenness, which is shown in table 2A.

Figure 6:
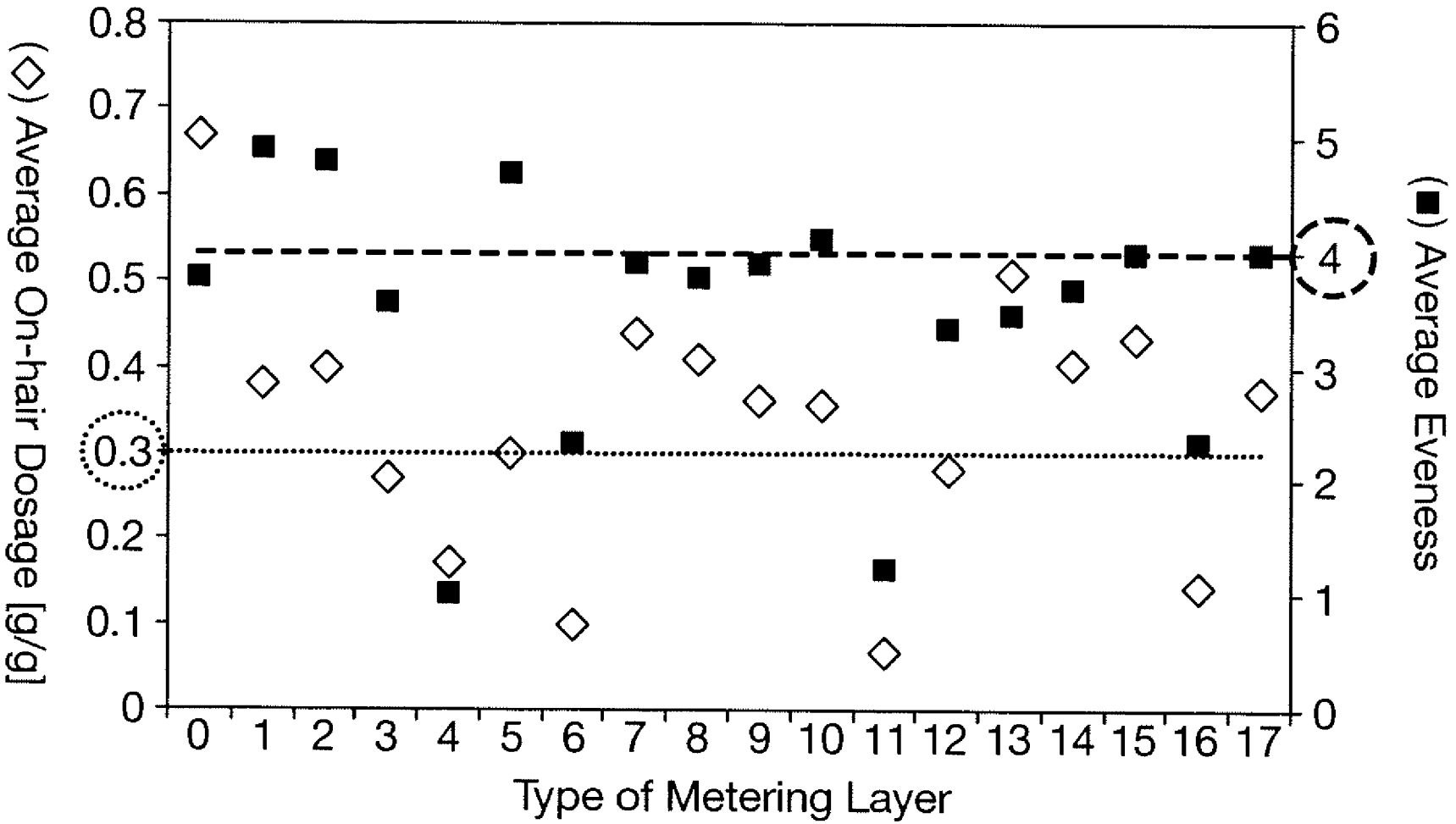
FIG. 6 shows for an embodiment of the applicator (1) according to the invention how the average on hair dosage (◇) and the average evenness (■) change by changing said first and second metering layers (50; 60) when a highlighting composition is applied to a bundle of hair strands.

FIG. 6 shows the average on-hair dosage in grams of pigmented hair treatment composition deposited per gram of hair (shown with the symbol ◇) and the average evenness (shown with the symbol ■) as a function of the type of metering layer tested. An applicator (1) as described above but without said at least one metering layer was also used as shown in FIG. 6, position 0. The calliper and the compressibility of these tested metering layers are summarized in table 2A below.

TABLE 2A

Summary of the type, calliper and compressibility of metering layers tested and of their performances for an average distance (D1) of about 2.0 mm. Where the sum of the callipers to achieve satisfactory performance is given by the mathematical relationship (I) for D1 = 2.0 mm as 8.750 ≧ Calliper (mm) ≧ 1.584 mm.

| Position in FIG. 6 | Metering Metering layer material | Independent Independent First and second Calliper (Average) [mm] | Callipers Callipers (Averages) [mm] (Sum of first and second) | Average Average Compression @ 0.5 kPa [%] | Average Average on-hair dosage [g/g] | Average Average evenness |
|---|---|---|---|---|---|---|
| 0 | none | 0 | 0 | 0 | 0.67 | 3.78 |
| 1 | PGI 214 2 mm | 2.074 | 4.148 | 62 | 0.38 | 4.89 |
| 2 | PGI 214 4 mm | 3.810 | 7.620 | 61 | 0.4 | 4.78 |
| 3 | PGI 214 5 mm | 5.201 | 10.402 | 62 | 0.27 | 3.56 |
| 4 | Libeltex 01-766 DI-8 | 6.772 | 13.544 | 74 | 0.17 | 1 |
| 5 | Libeltex 01-766 DI-4 | 4.375 | 8.750 | 64 | 0.3 | 4.67 |
| 6 | Foamex S80 | 1.983 | 3.966 | 96 | 0.1 | 2.33 |
| 7 | PGI WHS2930-121-1 | 3.313 | 6.626 | 42 | 0.44 | 3.89 |
| 8 | PGI WHS2970-164-2 | 0.774 | 1.548 | 56 | 0.41 | 3.78 |
| 9 | PGI WHS2970-164-2 X2 | 1.576 | 3.152 | 51 | 0.36 | 3.89 |
| 10 | USFELT F50 | 2.078 | 4.156 | 76 | 0.36 | 4.11 |
| 11 | Foamex HC-40 | 2.179 | 4.358 | 96 | 0.07 | 1.22 |
| 12 | PGI FB-213 | 6.576 | 13.152 | 77 | 0.28 | 3.33 |
| 13 | Avgol 5D-S31 | 0.344 | 0.688 | 70 | 0.51 | 3.44 |

TABLE 2A-continued

Summary of the type, calliper and compressibility of metering layers tested and of their performances for an average distance (D1) of about 2.0 mm. Where the sum of the callipers to achieve satisfactory performance is given by the mathematical relationship (I) for D1 = 2.0 mm as 8.750 ≧ Calliper (mm) ≧ 1.584 mm.

| Position in FIG. 6 | Metering Metering layer material | Independent Independent First and second Calliper (Average) [mm] | Callipers Callipers (Averages) [mm] (Sum of first and second) | Average Average Compression @ 0.5 kPa [%] | Average Average on-hair dosage [g/g] | Average Average evenness |
|---|---|---|---|---|---|---|
| 14 | BBA Fiberweb Tenotex P101 | 0.902 | 1.804 | 58 | 0.40 | 3.67 |
| 15 | Ahlstrom 18008 | 0.792 | 0.1584 | 63 | 0.43 | 4.00 |
| 16 | Alveo TA 1501 | 1.058 | 2.116 | 94 | 0.14 | 2.33 |
| 17 | Recticel Bulpren D32133 | 1.139 | 2.278 | 83 | 0.37 | 4.00 |

Column 1 in table 2 indicates the position of said metering layer in FIG. 6, column 2 indicates the type of metering layers, column 3 indicates the calliper as an average of three measurements performed according to the test method described below. Column 4 indicates the average sum of callipers of the first and second metering layer to provide the calliper of the at least one metering layer. Column 5 indicates the average compressibility in percentage measured from a triplicate experiment performed according to the test method defined herein below. Identical metering layers were tested at different callipers and different metering layers were tested at substantially identical callipers. Non-wovens, foams and combinations thereof were also tested. Columns 6 and 7 indicate the average on-hair dosage and the average evenness, respectively, of an application of said pigmented hair treatment composition to a bundle of hair strands as described above.

A satisfactory hair treatment application has been defined from the present inventors as to be the combination of an average evenness of at least about 4 and an average on-hair dosage of at least about 0.3 grams of pigmented hair treatment composition per gram of hair.

As can be seen in FIG. 6, an applicator (1) without a first and a second metering layer (50; 60), does not provide a satisfactory application of a hair treatment composition as the average evenness is not at least 4.

Figure 7:
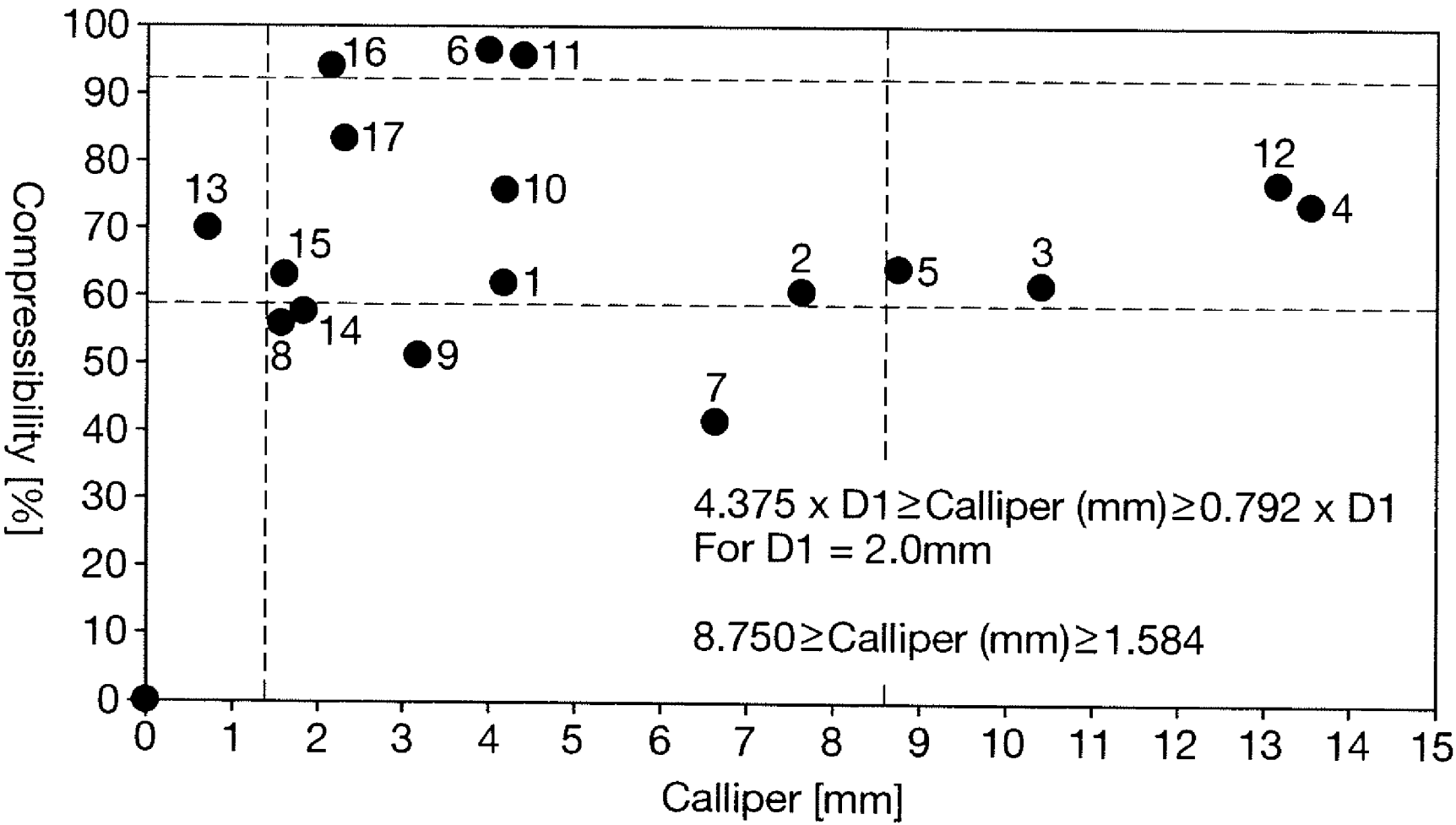
FIG. 7 shows examples of metering layers having different calliper (sum of independent callipers) and compressibility as defined herein for an average distance (D1) of about 2.0 mm.

The calliper and the compressibility as defined herein of each of said tested metering layers were reported in FIG. 7 and boundaries as dotted lines in FIG. 7 were traced around those metering layers that provided a satisfactory application of said pigmented hair treatment composition.

The highlighting product was left on the bundle of hair strands for about 30 minutes at 30° C. and rinsed with water for one minute and air dried for 24 hours. The bundle of hair strands treated with applicators with metering layers achieving satisfactory applications were observed to have changed to a uniform lighter color.

A second square well (20) was manufactured according to the dimensions above, in this case the substantially identical strips (11;12) were manufactured with a height of about 1.5 mm. When said internal surface (101) of said plate (10) is brought into a juxtaposed relationship to said opening (203) of said second well (20), said perimeter (103) of said plate (10) has an average distance (D1) of 1.5 mm to said rim (222) of said well (20).

The same experiment was repeated with the second applicator (1) with the same type of hair with the same method using selected metering layers from table 2A. The average dosage and evenness ratings are summarized in table 2B and reported in FIG. 8 where boundaries as dotted lines in FIG. 8 were traced around those metering layers that provided a satisfactory application of said pigmented hair treatment composition.

TABLE 2B

Summary of the type, calliper and compressibility of metering layers tested and of their performances for an average distance (D1) of about 1.5 mm. Where the sum of the callipers to achieve satisfactory performance is given by mathematical relationship (I) for D1 = 1.5 mm as 6.563 ≧ Calliper (mm) ≧ 1.188.

Figure 8:
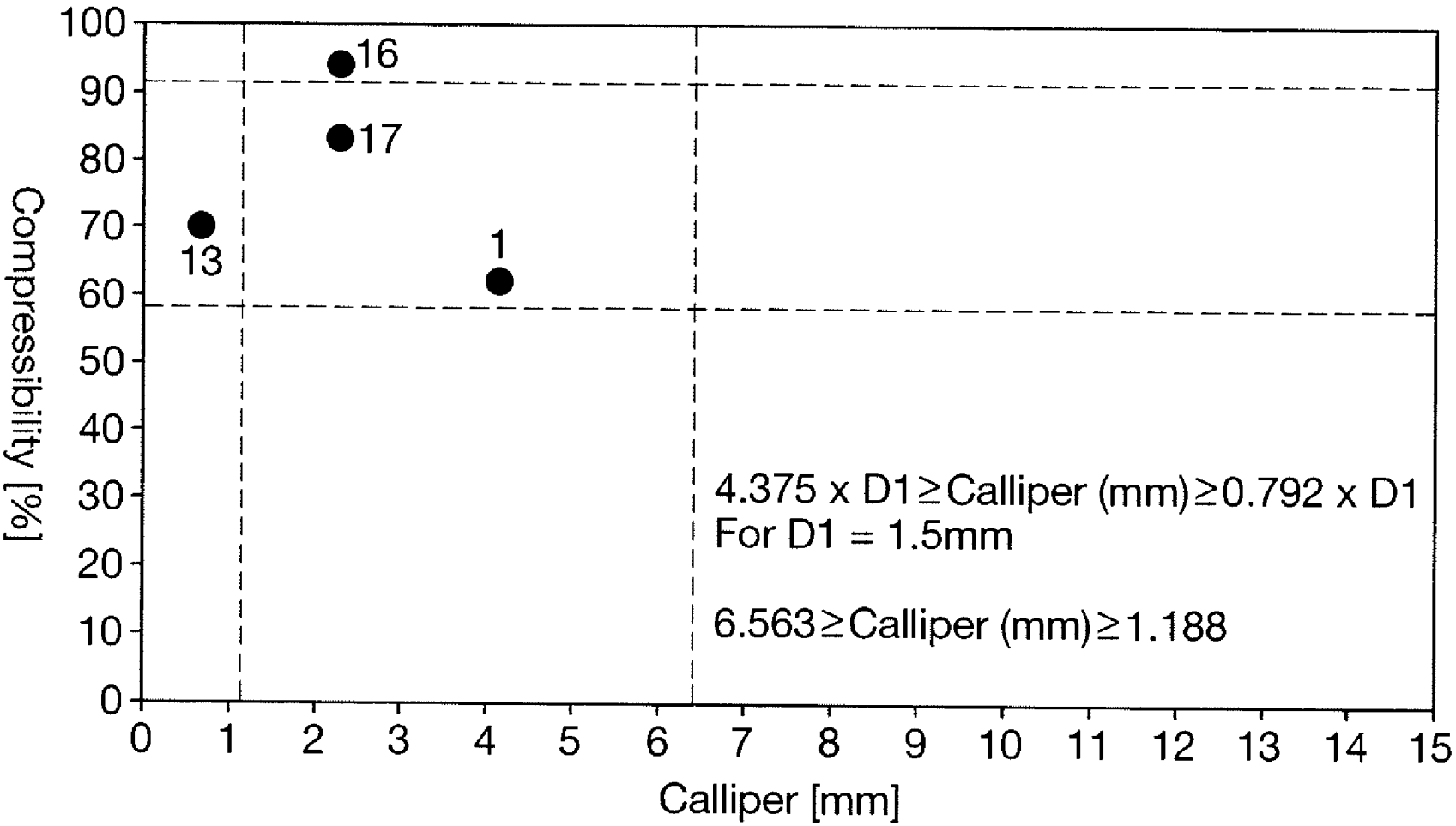
FIG. 8 shows examples of metering layers having different calliper (sum of independent callipers) and compressibility as defined herein for an average distance (D1) of about 1.5 mm.

| Position in FIG. 8 | Metering layer material | Independent first and second Calliper (Average) [mm] | Callipers (Averages) [mm] (sum of first and second) | Average Compression @ 0.5 kPa [%] | Average on-hair dosage [g/g] | Average evenness |
|---|---|---|---|---|---|---|
| 1 | PGI 214 2 mm | 2.074 | 4.148 | 62 | 0.65 | 4.33 |
| 13 | Avgol 5D-S31 | 0.344 | 0.688 | 70 | 0.92 | 2.78 |
| 16 | Alveo TA 1501 | 1.058 | 2.116 | 94 | 0.22 | 0.67 |

TABLE 2B-continued

Summary of the type, calliper and compressibility of metering layers tested and of their performances for an average distance (D1) of about 1.5 mm. Where the sum of the callipers to achieve satisfactory performance is given by mathematical relationship (I) for D1 = 1.5 mm as 6.563 ≧ Calliper (mm) ≧ 1.188.

| Position in FIG. 8 | Metering layer material | Independent first and second Calliper (Average) [mm] | Callipers (Averages) [mm] (sum of first and second) | Average Compression @ 0.5 kPa [%] | Average on-hair dosage [g/g] | Average evenness |
|---|---|---|---|---|---|---|
| 17 | Recticel Bulpren D32133 | 1.139 | 2.278 | 83 | 0.68 | 4.67 |

A third square well (20) was manufactured according to the dimensions above, in this case the substantially identical strips (11; 12) were manufactured with a height of about 3.0 mm. When said internal surface (101) of said plate (10) is brought into a juxtaposed relationship to said opening (203) of said second well (20), said perimeter (103) of said plate (10) has an average distance (D1) of 3.0 mm to said rim (222) of said well (20).

The same experiment was repeated with the second applicator (1) with the same type of hair with the same method using selected metering layers from table 2A. The average dosage and evenness ratings are summarized in table 2C and reported in FIG. 9 where boundaries as dotted lines in FIG. 9 were traced around those metering layers that provided a satisfactory application of said pigmented hair treatment composition.

TABLE 2C

Summary of the type, calliper and compressibility of metering layers tested and of their performances for an average distance (D1) of about 3.0 mm. Where the calliper required to achieve satisfactory performance is given by mathematical relationship (I) for D1 = 3.0 mm as 13.125 ≧ Calliper (mm) ≧ 2.376.

Figure 9:
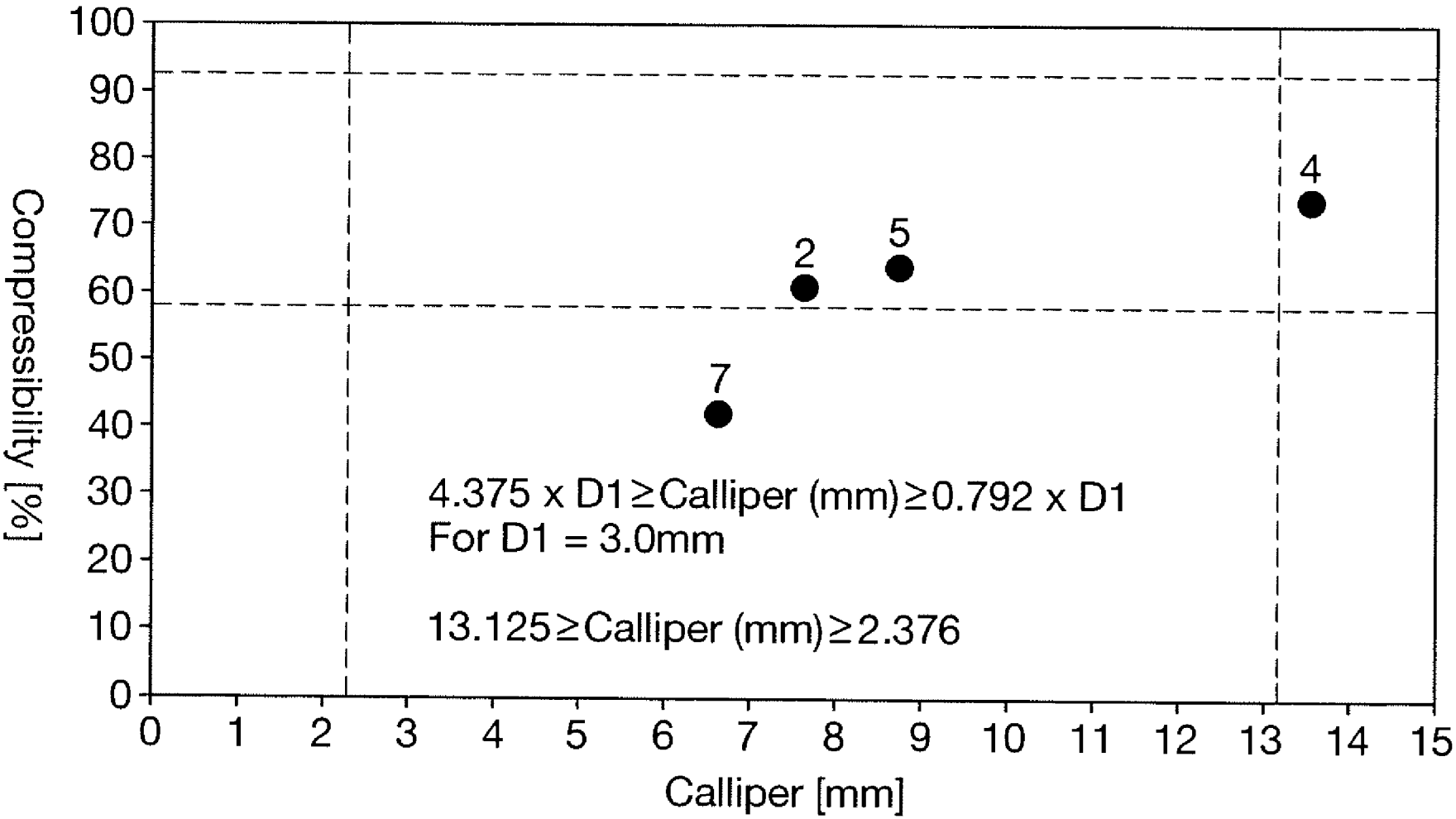
FIG. 9 shows examples of metering layers having different calliper (sum of independent callipers) and compressibility as defined herein for an average distance (D1) of about 3.0 mm.

| Position in FIG. 9 | Metering layer material | Independent first and second Calliper (Average) [mm] | Callipers (Averages) (sum of first and second) [mm] | Average Compression @ 0.5 kPa [%] | Average on-hair dosage [g/g] | Average evenness |
|---|---|---|---|---|---|---|
| 2 | PGI 214 4 mm | 3.810 | 7.620 | 61 | 0.52 | 5.00 |
| 4 | Libeltex 01-766 DI-8 | 6.772 | 13.544 | 74 | 0.29 | 2.67 |
| 5 | Libeltex 01-766 DI-4 | 4.375 | 8.750 | 64 | 0.56 | 4.78 |
| 7 | PGI WHS2930-121-1 | 3.313 | 6.626 | 42 | 0.76 | 3.22 |

These experimental data show that according to the present invention's standards, the calliper and the compressibility, as defined herein, of said first metering layer (50), preferably of said first and second metering layers (50; 60) correlate with the average on-hair dosage and the average evenness of an application with an applicator (1) according to the invention. Only a specific range of calliper and of compressibility provide for a satisfactory application, regardless on whether said metering layer is a non-woven, a foam or a combination thereof. In addition, the same metering layer has to be selected at the right calliper and at the right compressibility to provide for a technical effect as described herein, and said compressibility as defined herein from about 59% to about 93% and said calliper being defined by mathematical relationship (I)

$$4.375 \times D1 \geqq \text{Calliper (mm)} \geqq 0.792 \times D1 \quad \text{(I)}$$

wherein said calliper is the sum of the independent callipers of said first and second metering layers.

4. Additional Features

The applicator (1) may further comprise one or more sealing means, preferably one sealing means (401) is present within the hair treatment applicator (1). Said sealing means (401) may be located within said well (20) on said bottom (201) at the wall (202) adjacent to said connection (30) as shown in FIG. 3. Said sealing means (401) may be located on the bottom (201) of said well (20) adjacent to said wall (202) at the side of the connection (30) or on said internal surface (101) adjacent to said connection (30). Preferably said sealing means (401) is part of said connection (30).

The sealing means (401) is provided to avoid displacement of hair treatment composition towards the connection (30) and hair from being trapped within said connection (30) when said internal surface (101) of said plate (10) is brought into a juxtaposed relationship to said opening (203) of said well (20). By having a sealing means (401) on the bottom (201) of said well (20) adjacent to said wall (202) at the side of said connection (30), when the plate (10) is moved toward said well (20) by pivoting about the connection (30) the hair treatment composition is prevented from being displaced toward the connection (30) itself. An additional advantage related to certain embodiments of said sealing means (401) is that it comprises a visual aid to help the user to understand where and how much hair treatment composition should be loaded within the internal volume (204) of said well (20). The sealing means (401) acts as a barrier for the hair treatment composition, which is instead forced to stay within said well (20) where it will be available for coating the bundle of hair strands avoiding messiness.

Useful materials to manufacture a sealing means (401) may be selected from those detailed herein above to manufacture said plate (10). Other materials which could be used include polyurethane and polyolefin foams, non-wovens, felts, where appropriate; flexible pliable substrates such as paper boards, metal based substrates and aluminium foils, filmic substrates or multiple laminations or combinations of multiple layers of said materials. The said sealing means (401) may be manufactured by a combination of the materials described above.

One or more stop mechanisms may be incorporated onto said applicator (1). The stop mechanism collaborates with said connection (30) to ensure that when said internal surface (101) of said plate (10) is brought into a juxtaposed relationship to said opening (203) of said well (20), the average distance (D1) between said perimeter (103) and said rim (222) is controlled. One or more stop mechanism may reduce the treatment composition being forced beyond said rim (222) of said well (20).

In certain embodiments, the stop mechanism may be manufactured during the same manufacturing step as said plate (10), said well (20) and said connection (30) with the same or different material. In certain embodiments the stop mechanism may be one or more tines, teeth of a comb-like structure. In one embodiment as shown in FIG. 3, two stop mechanisms are comprised on said rim (222) of said wall (201) of said well (20), preferably said two stop mechanisms are two substantially identical hemispheres (402; 403). In certain other embodiments, not shown herein, the stop mechanism may be integrated within connection (30) itself.

Useful materials to manufacture a stop mechanism (402) may be selected, where appropriate, from those detailed herein above to manufacture said plate (10) and combinations thereof.

Fingers may be used to select the hair strands on which the hair treatment composition should be applied. The applicator (1) of the present invention may however be further provided with hair strand selection means. Examples of hair strand selection means are, but not limited to, spikes, hooks, crochets, clips or beads. The hair strand selection means may be incorporated onto said plate (10) and/or said well (20). Said means may also be attached through a snap mechanism to said plate (10) and/or said well (20) such that the hair strand selection means may swing from a position proximal to said plate (10) and/or said well (20) to a far one, such as happens with the blades of a penknife. The hair strand selection means may also be separately provided to the applicator (1) of the present invention as a component of a kit as described herein below.

The applicator (1) disclosed herein may further comprise gripping areas on the external surfaces (102) of said plate (10) and/or on said bottom (201) of said well (20). Said gripping areas are designed to provide grip. These gripping areas may be manufactured using co-injection or over-moulding techniques when the hair treatment applicator is manufactured. Useful materials include, but are not limited to, those materials detailed herein above for the manufacture of said sealing means (401) and combinations thereof.

In addition, the gripping areas may be formed through embossing, debossing or coating of the external surfaces (102) of said plate (10) and/or of said bottom (201) of said well (20). Gripping means may be cavities present on the external surface (102) of said plate (10) and/or on said bottom (201) of said well (20). Finally, the gripping means may be provided as fastening means to accommodate the user's fingers.

To protect said internal surface (101) of said plate (10), said first (50) and/or second (60) metering layers and/or the opening (203) of said well (20) release liners or barriers may be present. The release liner or barrier may be peelable or resealable and may be constructed from a plastic, aluminium laminate constructions. Some examples of these materials include: laminates of low density polyethylene or blends of polyethylene with poly-isobutylene with aluminium foil and polyethylene terephthalate or bi-orientated polypropylene peel-able foils and may be made of a gas resistant material, especially for hair treatment composition comprising hydrogen peroxide, including aluminium laminated foil, metalised aluminium onto a plastic carrier, Aclar® polychloro-trifluoroethylene, polyvinylidene chloride, ethylene-vinyl alcohol copolymer, silica and aluminium oxides.

One or more means suitable to attach, adapt or install a dispensing or loading device to perform the loading of the hair treatment composition into the applicator (1) according to the invention may be present. Examples of said means are, but not limited to, nozzles and orifices, pouch pocket or one-way or two-way valves present on said plate (10) and/or said bottom (201) and/or wall (202) of said well (20). Said means may be permanently connected to the applicator (1) or may be removable, they may be disposable or recyclable and they may be provided as a separate component of a kit as described herein below.

6. Method of Use

The present invention also relates to a method to apply a hair treatment composition with said applicator (1) according to the invention to a hair strand, preferably a bundle of hair strands, wherein said applicator (1) comprises said hair treatment composition and whereby said hair strand is contacted with said applicator (1). Said applicator (1) may be preloaded with one or more hair treatment compositions, but preferably one or more hair treatment compositions are loaded into said applicator (1) before the contact of said hair strand, preferably said bundle of hair strands, with said applicator (1).

The hair treatment composition can be loaded onto the hair treatment applicator (1) by any means. In one embodiment the hair treatment composition is loaded directly into said internal volume (204) of said well (20) by applying the hair treatment composition for example with a spatula or a syringe, by a squeezable tube, by a dispensing bottle, by a single or dual phase pump, by a single or dual phase piston causing volumetric displacement, by a sachet or by any other suitable dispenser. When an optional means to perform the loading of the hair treatment composition into the hair treatment applicator (1) as described above is present, the hair treatment composition may be loaded into said well (20) through a one-way or two-way valve present in said means and/or in said wall (202) or bottom (201) of said well (20).

The hair treatment compositions may be a single hair treatment composition or may be formed by a first hair treatment composition which requires mixing with a second hair treatment composition before application to the hair. Preferably, said first and second hair treatment compositions are mixed to form a third hair treatment composition. Said third hair treatment composition is loaded in said hair treatment applicator (1) before contacting the hair strand, preferably a bundle of hair strands, with said hair treatment applicator (1). Said first and second hair treatment composition may be mixed by shaking or stirring before loading into said hair treatment applicator (1) or may be mixed during the loading procedure by employing specialized two or multi-chambered containers coupled with a static mixer. The mixing may also be performed by interposing an additional means capable of mixing two or more hair treatment compositions or capable of mixing powders with water or other solvents to make a hair treatment composition. Said interposed means can also be provided with features to inject or load the mixed hair treatment compositions into the hair treatment applicator (1).

Multiple or subsequent loading may be accomplished by positioning, the hair treatment applicator (1) in a tray or by connecting or attaching the hair treatment applicator (1) to multi-chambered bottles, tubes or other applicators capable of dispensing either the single or the total amount of the hair treatment composition needed. When a tray is used, said tray comprises at least one compartment where the hair treatment applicators (1) are positioned or adapted. The tray may further comprise one or more compartments where the hair treatments compositions are loaded and/or stored and which are in communication with the hair treatment applicator (1).

The amount of hair treatment composition loaded on the hair treatment applicator (1) depends upon its size and capacity and the desired end results. The hair treatment applicator (1) may be preferably loaded with an amount of hair treatment composition from about 0.5 gram to about 20 grams, more preferably from about 0.75 gram to about 17 grams, even more preferably from about 1 gram to about 10 grams of hair treatment composition.

Once the hair treatment applicator (1) is loaded with one or more hair treatment compositions, the user holds through the external surfaces (102) of said plate (10) and bottom (201) of said well (20) of said applicator (1) in one hand, preferably between the thumb and the index finger. Once the user has selected the hair strands to be treated, said hair strand, preferably said bundle of hair strands, is located between said plate (10) and said containment portion (20) while the applicator (1) is in an open state. Subsequently said internal surface (101) of said plate (10) is brought into a juxtaposed relationship to said opening (203) of said well (20). Said applicator (1) is swiped along the length of said hair strand, preferably on said bundle of hair strands, and one or more hair treatment compositions are applied. More preferably, said hair treatment applicator (1) is located at the root-line of said hair strand, preferably at the root-line of said bundle of hair strands. The hair treatment composition may also be applied only to limited areas of the hair, i.e. the user can coat only the root-line with the hair treatment composition. The swiping may be repeated more than once, preferably twice.

In certain embodiments a first hair treatment composition is applied to the hair via any of the known conventional methods as a pre- or post-treatment, a second hair treatment composition can be applied via the hair treatment applicator (1) according to the present invention. For example the first hair treatment composition is a dyeing composition to perform a full head colouration and the second hair treatment composition is a highlighting composition used to add variation in colour to the full head coloration. Alternatively a different dyeing composition could be used after the full head colouration to add variation in hair colour. Those skilled in the art would understand that many such combinations of hair treatment compositions may be used to create different results.

Finally, the application of the hair treatment composition may occur on wet or dry hair and optionally, a rinsing or a shampooing step can be included between application of the first and second compositions to the hair.

7. Hair Treatment Compositions, Use Thereof and Kit

The present invention further comprises a kit. Said kit comprises an applicator (1) according to the invention and one or more individually packaged hair treatment compositions. Preferably, these compositions are selected from the group consisting of styling compositions, dyeing compositions, highlighting compositions or combination thereof. Each of these hair treatment compositions or combinations thereof may be used to provide a hair strand effect with said applicator (1) described above. Preferably said one or more hair treatment compositions have a rheology of from about 10 Pa to about 160 Pa, more preferably of from about 12 Pa to about 120 Pa, most preferably from 15 Pa to 80 Pa at 1 $s^{-1}$. More preferably, said one or more hair treatment composition is a highlighting composition.

The rheology of the hair treatment composition is measured using a TA Instruments Advanced Rheometer (AR) 2000. The instrument is provided with a concentric cylinder base with an internal radius of 15.00 mm and standard size vane geometry with a radius of 14.00 mm and a height of 42.00 mm. The geometry gap is set at 4000 microns. Hair treatment compositions which are made up of more than one formulation are prepared by mixing those various formulations thoroughly by hand shaking in a sample pot for 30 seconds. The mixed hair treatment composition is then placed immediately into the concentric cylinder base, and the standard vane geometry is lowered to the geometry gap such that the top of the vanes are covered by the hair treatment compositions. The temperature is equilibrated to 25° C., and then hair treatment composition is left for an additional 30 seconds before the shear rate increases logarithmically from about 0.05 to about 200 $s^{-1}$, recording seven points per decade. At all stages the temperature is maintained at 25° C. The shear stress is recorded at 1.0 $s^{-1}$ and reported in Pa.

Examples of hair treatment compositions which can be used with the hair treatment applicator (1) according to the invention are indicated below in tables 5, 6 and 7.

The hair treatment compositions may comprise components known, conventionally used, or otherwise effective for use in hair treatment compositions particularly oxidative bleaching and dye compositions which include but are not limited to: developer dye compounds; coupler dye compounds; direct dyes; oxidizing agents; reducing agents; thickeners; chelants; pH modifiers and buffering agents; alkalising agents, carbonate ion sources and radical scavenger systems; glycine; amodimethicone, ethylenediamine disuccinic acid; anionic, cationic, non-ionic, amphoteric or zwitterionic surfactants, or mixtures thereof; anionic, cationic, non-ionic, amphoteric or zwitterionic polymers, hydrophobically modified polymers or mixtures thereof; fragrances; dispersing agents; solvents, peroxide stabilizing agents; chelants, humectants, proteins and derivatives thereof, plant materials (e.g. aloe, chamomile and henna extracts); silicones (volatile or non-volatile, modified or non-modified), film-forming agents, cellulose polymers and their derivatives, ceramides, preserving agents, gel networks, colour indicators and opacifiers. Some adjuvants which are suitable are listed in the International Cosmetics Ingredient Dictionary and Handbook, (8th ed.; The Cosmetics, Toiletry, and Fragrance Association). Particularly, vol. 2, sections 3 (Chemical Classes) and 4 (Functions) are useful in identifying specific adjuvants to achieve a particular purpose or multipurpose. A representative but not exhaustive list of polymers and thickening agents can be found in "The Encyclopaedia of Polymers and Thickeners for Cosmetics" compiled and edited by Robert Y. Lochhead, PhD and William R. Fron, Department of Polymer Science, University of Southern Mississippi.

The present invention further comprises a kit. Said kit comprises an applicator (1) as described above and one or more individually packaged hair treatment compositions. More than one applicator (1) may be comprised in said kit.

In one embodiment of the present invention, said one or more individually packaged hair treatment compositions comprise a first individually packaged hair treatment composition and a second individually packaged hair treatment composition. When mixed said first and second individually packaged hair treatment compositions form a third hair treatment composition. Examples of such compositions include so called semi-permanent and permanent colorants which typically contain oxidative dyes and an oxidant, and highlighting compositions containing an oxidant and an alkalising agent, optionally with a persulfate salt. Preferably, said first individually packaged composition comprises an oxidizing agent and said second individually packaged composition comprises an alkalizing agent. Preferably, said oxidizing agent is hydrogen peroxide. More preferably, at least one of said first and/or second individually packaged hair treatment composition comprises a persulfate salt.

In one embodiment of the kit according to the present invention said first individually packaged hair treatment composition comprises from 3% to 12% of hydrogen peroxide by weight of said first individually packaged hair treatment composition and said second individually packaged hair treatment composition is in the form of a powder or paste activator and said second individually packaged hair treatment composition comprises from 10% to 60% of persulfate salt selected from sodium persulfate, potassium persulfate, ammonium persulfate or mixtures thereof, by weight of said second individually packaged hair treatment composition. Said kit optionally comprises a third individually packaged hair treatment composition comprising from 3% to 25% of an alkalizing agent in an aqueous vehicle, by weight of said third individually packaged hair treatment composition.

In another embodiment of the present invention said first individually packaged hair treatment composition comprises from 1.5% to 12% of hydrogen peroxide by weight of said first individually packaged hair treatment composition and said second individually packaged hair treatment composition comprises from 0.01% to 6% of a dye selected from direct dyes, oxidative dye precursors, oxidative dye couplers or mixtures thereof, by weight of said second individually packaged hair treatment composition.

Additional individually packaged hair treatment compositions may be present in the kit and may comprise shampoos, conditioner or styling products.

Herein below in are given some examples of hair treatment compositions which may be loaded into the hair treatment applicator (1) according to the invention.

A hair bleaching composition was prepared by mixing about 45 g of any of the formulations of Phase 1 (1.1, 2.1, 3.1, 4.1, 5.1, 6.1, 7.1, 8.1 or 9.1, table 3), which were in a liquid form with about 15 g of any of the formulations of Phase 2 (1.2, 2.2, 3.2, 4.2, 5.2, 6.2, 7.2, 8.2 or 9.2 in table 3), which were in a powder form. Mixing was achieved as follows: the powder formulation of Phase 2 was placed into a mixing tray and the liquid formulation of Phase 1 was poured on top of the powder. The two formulations were then mixed together using a spatula to form a bleaching composition. Mixing was completed when the bleaching composition looked visually homogeneous.

TABLE 3

Formulations of Phase 1 and 2 which can be mixed to form a highlighting composition. All ingredients are in percentage by weight of the formulation phase.

| Phase 1 | 1.1 | 2.1 | 3.1 | 4.1 | 5.1 | 6.1 | 7.1 | 8.1 | 9.1 |
|---|---|---|---|---|---|---|---|---|---|
| De-ionized Water | q.s. to 100% | q.s. to 100% | q.s. to 100% | q.s. to 100% | q.s. to 100% | q.s. to 100% | q.s. to 100% | q.s. to 100% | q.s. to 100% |
| Glycerine | 5.00 | | | | | | | | |
| Hydrogen Peroxide (35% Active) | 17.20 | 17.20 | 17.20 | 17.20 | 17.20 | 17.20 | 17.20 | 17.20 | 17.20 |
| Disodium EDTA | 0.04 | 0.04 | 0.04 | 0.04 | 0.04 | 0.04 | 0.04 | 0.04 | 0.04 |
| Carbopol ™ 956 [1] | 1.00 | | | | | | | | |
| Sodium Hydroxide (50% aq. Solution) | q.s. to pH 3.5 | q.s. to pH 3.5 | q.s. to pH 3.5 | q.s. to pH 3.5 | q.s. to pH 3.5 | q.s. to pH 3.5 | q.s. to pH 3.5 | q.s. to pH 3.5 | q.s. to pH 3.5 |
| Keltrol ™ T [2] | | | 1.25 | | | | | | |
| Stearyl Alcohol [3] | | 2.00 | | 1.00 | 1.00 | 2.00 | 2.00 | 2.00 | 2.00 |
| Cetyl Alcohol [4] | | 3.00 | | 1.50 | 1.50 | 3.00 | 3.00 | 3.00 | 3.00 |
| Cetearth 25 [5] | | 1.50 | | 0.75 | 0.75 | 1.50 | 1.50 | 1.50 | 1.50 |
| Aculyn ™ 33 [6] | | | | 2.40 | | | | | |
| Natrosol ™ Plus CS Grade 330 [7] | | | | | 1.25 | | | | |
| Salcare ™ SC 90 [8] | | | | | | | 1.00 | | |
| **Phase 2** | **1.2** | **2.2** | **3.2** | **4.2** | **5.2** | **6.2** | **7.2** | **8.2** | **9.2** |
| Persulfate Powders | | | | | | | | | |
| Ammonium Persulfate | 28.60 | 28.60 | 28.60 | 28.60 | 28.60 | 28.60 | 28.60 | 28.60 | 28.60 |
| Potassium Persulfate | 50.00 | 50.00 | 50.00 | 50.00 | 50.00 | 50.00 | 50.00 | 46.00 | 47.00 |
| Sodium Persulfate | 7.14 | 7.14 | 7.14 | 7.14 | 7.14 | 7.14 | 7.14 | 7.14 | 7.14 |
| Sodium Metasilicate | 14.26 | 14.26 | 14.26 | 14.26 | 14.26 | 14.26 | 14.26 | 14.26 | 14.26 |

TABLE 3-continued

| Formulations of Phase 1 and 2 which can be mixed to form a highlighting composition. All ingredients are in percentage by weight of the formulation phase. | | |
|---|---|---|
| Keltrol T | 4.00 | |
| (Xanthan Gum) | | |
| Carbopol ™ | | 3.00 |
| Ultrez 10 [9] | | |

[1] Carbopol ™ 956, Noveon Inc.
[2] Keltrol ™ T - CP Kelco
[3] Stearyl Alcohol Crodacol S-95, Croda, Inc.
[4] Cetyl Alcohol, Crodacol C-70, Croda, Inc.
[5] Cetearth 25, Cremophor A 25, BASF Corporation
[6] Aculyn ™ 33, Rohm and Hass Company Inc.
[7] Natrosol ™ Plus CS Grade 330, Hercules Incorporated
[8] Salcare ™ SC 90 Ciba Specialty Chemicals Corporation
[9] Carbopol ™ Ultrez 10

In another example a bleaching composition was prepared by mixing into a tray with a spatula 30 g of component (a1), in table 4, comprising hydrogen peroxide with 15 g of component (b1), in table 4, comprising persulfate salts. In another example a bleaching composition was prepared as follow: 10 g of component (b2), in table 4, comprising persulfate salts in a powder form were added into a bottle of about 160 ml which already contained about 60 g of component (a2), in table 4. Finally, about 20 g of component (c2), in table 4, comprising ethanolamine, was added to the bottle. The bottle was closed with a cap provided with a nozzle. Mixing was achieved by hand shaking the bottle with the three components till a homogeneous hair bleaching composition was formed.

TABLE 4

| Formulations of components (a1), (a2), (b1), (b2) and (c2) which can be mixed to form a highlighting composition. All ingredients are indicated in grams. | | |
|---|---|---|
| Ingredients | (a1) | (a2) |
| Water | 78.54 | 67.34 |
| hydrogen peroxide (35% active) | 17.14 | 25.71 |
| Cetearyl alcohol [10] | 2.25 | |
| trideceth 2 carboxamide MEA [11] | 0.85 | |
| ceteareth-30 [12] | 0.60 | |
| glycerin | 0.50 | |
| pentasodium pentetate [13] | 0.06 | |
| sodium stannate | 0.04 | |
| tetrasodium pyrophosphate | 0.02 | |
| Cetearyl Alcohol (and) Ceteareth-20 [14] | | 1.5 |
| Glyceryl Stearate [15] | | 4.0 |
| Oleth-10 [16] | | 0.3 |
| Oleth-2 [17] | | 0.3 |
| Stearamidopropyl Dimethylamine [18] | | 0.6 |
| Etidronic Acid | | 0.25 |
| Ingredients | (b1) | (b2) |
| potassium persulfate | 43.8 | 35 |
| sodium silicate | 22.5 | 35 |
| sodium persulfate | 11 | |
| Ammonium persulfate | | 27.5 |
| acrylates/C10-30 alkyl acrylate crosspolymer [19] | 4.3 | |
| Urea | 3 | |
| Kaolin | 2.9 | |
| Magnesium Stearate [20] | 2.8 | |
| Ammonium Chloride | 2.6 | |
| diethylhexyl sodium sulfosuccinate [21] | 2 | |
| VP/VA copolymer [22] | 2 | |
| Polydecene [23] | 1.7 | |
| Sodium lauryl sulfate [24] | | 1.5 |
| sodium metasilicate | 1.6 | |
| EDTA | 0.8 | 1 |

TABLE 4-continued

| Formulations of components (a1), (a2), (b1), (b2) and (c2) which can be mixed to form a highlighting composition. All ingredients are indicated in grams. | |
|---|---|
| Ingredients | (c2) |
| Water | 56.3 |
| Ethanolamine | 15.0 |
| Cetearyl alcohol/hydroxyethyl behenamidopropyl dimonium chloride/hexylene glycol [25] | 2.5 |
| Cocamide MEA [26] | 12.0 |
| Dilinoleic acid [27] | 4.0 |
| Disodium wheatgermamphodiacetate [28] | 3.0 |
| Linoleamidopropyl dimethylamine dimer dilinoleate [29] | 2.0 |
| Stearamide MEA [30] | 4.0 |
| Sodium sulfite | 0.5 |
| EDTA | 0.2 |
| Erythorbic acid | 0.5 |

[10] Cetearyl alcohol - Crodacol CS-50, Croda Inc
[11] Trideceth 2 carboxamide MEA - Aminol A 15, Kao Chemicals GmbH
[12] Ceteareth-30 - Eumulgin ™ B 3, Cognis GmbH
[13] Pentasodium pentetate - Versenex 80, Dow Chemicals
[14] Cetearyl Alcohol (and) Ceteareth-20 - Crodex N, Croda Inc
[15] Glyceryl Stearate - Cithrol GMS 0400, Croda Inc
[16] Oleth-10 - Volpo 10, Croda Inc.
[17] Oleth-2 - Volpo N2, Croda Inc.
[18] Stearamidopropyl Dimethylamine - Incromine SB, Croda Inc.
[19] Acrylates/C10-30 alkyl acrylate crosspolymer, Carbopol ™ Ultrez 20, Noveon Inc.
[20] Magnesium Stearate - Radiastar ™ 1100, Oleon NV
[21] Diethylhexyl sodium sulfosuccinate, Geropon SS-0-75, Rhodia Inc.
[22] VP/VA copolymer - Luviskol ™ VA73E BASF Corporation
[23] Polydecene - Puresyn ™ 1000 ExxonMobil Chemical Company
[24] Sodium lauryl sulfate - Empicol LX32, Albright and Wilson UK Ltd
[25] Cetearyl alcohol/hydroxyethyl behenamidopropyl dimonium chloride/hexylene glycol, Incroquat Behenyl HE, Croda Inc.
[26] Cocamide MEA, Amidex CME, Rhodia.
[27] Dilinoleic acid, Empol 1008, Cognis Corporation
[28] Disodium wheatgermamphodiacetate, Mackam 2W, McIntyre Group Ltd
[29] Linoleamidopropyl dimethylamine dimer dilinoleate, Necon LO-80, Alzo/Bernal Chemical
[30] Stearamide MEA Rewomid S280, Degussa Care and Surface Specialities In another example a dying composition containing direct dyes as indicated in table 5, formulation (a4), may be used directly with no preparation step required.

In a further example, a dying composition comprising oxidative dyes was prepared by mixing in a bottle by vigorous shaking about 60 g of formulation (a5), in table 7, with about 60 g of formulation (b5), in table 5.

TABLE 5

Dyeing composition (a4) and formulations (a5) and (b5) which can be mixed to form a dying composition comprising oxidative dyes. All ingredients are indicated in grams.

| Ingredients | (a4) | a5 |
|---|---|---|
| Water | 95.49 | 66.45 |
| Ammonium hydroxide 31.9% solution | | 6.00 |
| Oleth-10 [31] | | 4.00 |
| C12-15 Pareth-3 [32] | | 2.50 |
| Steareth-21 [33] | | 4.00 |
| Dilinoleic Acid [34] | | 3.50 |
| Cocamide MEA [35] | | 4.00 |
| Behentrimonium Chloride [36] | | 2.60 |
| Linoleamidopropyl Dimethylamine Dimer Dilinoleate [37] | | 3.00 |
| Erythorbic Acid | | 0.40 |
| Sodium Sulfite | | 0.25 |
| EDTA acid | | 0.05 |
| Sodium Sulfate | | 0.50 |
| M-Aminophenol [38] | | 0.50 |
| 1-Naphthol [39] | | 0.25 |
| Resorcinol [40] | | 1.00 |
| P-Phenylenediamine [41] | | 0.75 |
| P-Aminophenol [42] | | 0.25 |
| HC Yellow No. 2 [43] | 0.20 | |
| Disperse Black 9 [44] | 0.05 | |
| HC Red No. 3 [45] | 0.15 | |
| Disperse Violet 1 [46] | 0.05 | |
| Erythorbic Acid | 0.025 | |
| Citric Acid | 0.5 | |
| Emanolamine | 2.5 | |
| Carbopol 956 [47] | 0.83 | |
| HC Orange No. 1 [48] | 0.1 | |

| Ingredients | (b5) |
|---|---|
| Water | 82.84 |
| Hydrogen peroxide (35% active) | 17.14 |
| Etidronic Acid | 0.02 |

[31] Oleth-10 - Volpo 10, Croda Inc.
[32] C12-15 Pareth-3, Neodol 25-3, Shell Chemical Company
[33] Steareth-21 - Cromul EM1207, Croda Inc
[34] Dilinoleic Acid - Empol 1008, Cognis Corporation
[35] Cocamide MEA - Amidex CME, Rhodia.
[36] Behentrimonium Chloride - Incroquat Behenyl TMC-85 - Croda Inc.
[37] Linoleamidopropyl Dimethylamine Dimer Dilinoleate - Necon LO-80, Alzo/Bernal Chemical
[38] M-Aminophenol - Rodol EG, Jos. H. Lowenstein & Sons, Inc.
[39] 1-Naphthol - Rodol ERN, Jos. H. Lowenstein & Sons, Inc.
[40] Resorcinol - Rodol RS, Jos. H. Lowenstein & Sons, Inc.
[41] P-Phenylenediamine - Rodol D, Jos. H. Lowenstein & Sons, Inc.
[42] P-Aminophenol Rodol P Base(Jos. H. Lowenstein & Sons, Inc.
[43] HC Yellow No. 2 - Velsol Yellow 2, Clariant Corporation
[44] Disperse Black 9 - Lowadene Black 9, Jos. H. Lowenstein & Sons, Inc.
[45] HC Red No. 3 - Velsol Red 3, Clariant Corporation
[46] Disperse Violet 1 - Lowadene Violet 1, Jos. H. Lowenstein & Sons, Inc.
[47] Carbopol 956, Noveon Inc.
[48] HC Orange No. 1 - Colorex HCO1, Chemical Compounds Inc.

8. Test Methods

Calliper

The calliper of a metering layer was determined using the general procedure described in "ASTM D 5736-95 Standard Test Method for Thickness of Highloft Non-Woven Fabrics". A die cutter was used to prepare circular samples of metering layer of about 35.7 mm in diameter. Care was taken to avoid compression and/or disturbance of the metering layer during handling. Any metering layer with defects, such as folds, wrinkles, non-uniformity, creases or cut marks etc, were rejected from testing. The calliper was measured on a TA Instruments Ltd DMA 2980 with two parallel circular plates of 40 mm in diameter (compressive plates—anvil and presser foot) setup and calibrated in the compressive plates mode according to the manufacturer's guidelines. Any equipment capable of measuring the calliper according to the procedure described herein can be used. The opposing flat surfaces of the two parallel plates were brought in contact from their resting position and the dimensional change was manually zeroed. The plates were restored to their resting position and the metering layer to be tested was centrally positioned on the surface of the lower plate avoiding any compression and/or disturbance to the substrate during handling. The preload force was set to zero Newton. A 0.02 kPa pressure was applied to the sample in 5 seconds and the pressure held constant for an additional 10 seconds. The calliper was recorded at a time between 9 to 10 seconds after the 0.02 kPa had been reached. The measurement was repeated three times for each metering layer on a new sample. The average calliper at 0.02 kPa was defined as being the average calliper and was recorded to the nearest 0.001 mm. The same method was applied to measure the calliper of metering layer non-wovens, foams and combinations thereof.

Compressibility

The compressibility of a metering layer was determined as the percentage compressibility according to the following equation (II)

$$\%\ \text{Compressibility} = 100 \times \frac{\text{Calliper at 0.5 kPa}}{\text{Calliper at 0.02 kPa}} \qquad \text{(II)}$$

The calliper of the metering layer was first determined at a pressure of 0.02 kPa as described above on a TA Instruments Ltd DMA 2980. Any equipment capable of measuring the compressibility according to the procedure described herein below can be used. The calliper was recorded at a time between 9 to 10 seconds after the 0.02 kPa had been reached. A pressure of 0.5 kPa was then applied to the same sample in 5 seconds and the pressure held constant for an additional 10 seconds. After the pressure was held constant the calliper at 0.5 kPa was recorded at a time between 9 to 10 seconds. The measurement was repeated three times for each metering layer on a new sample. The average calliper at 0.5 kPa was recorded to the nearest 0.001 mm and the percentage compressibility was calculated according to the equation (II) above. The same method was applied to measure the calliper of metering layers selected from non-wovens, foams or combinations thereof. A pressure of 0.5 kPa was chosen to measure the calliper of the metering layers to determine their compressibility. This represents a meaningful pressure that consumers may apply to the applicator (1) according to the invention. In addition a pressure of 0.5 kPa allows the compressibility of different metering layers to be measured from one another.

Average Distance (D1)

The average distance (D1) between said perimeter (103) of said plate (10) and said rim (222) of said well (20) was measured when said applicator is in a closed state and said internal surface (101) of said plate is in a juxtaposed relationship to said opening of said well (20). A Mitutoyo Digimatic callipers was positioned at said perimeter (103) and the distance from said perimeter (103) to said rim (222) was measured. This measurement was repeated for another ten positions around the perimeter (103) and the rim (222). Said ten positions were taken as each equally spaced along the length of said rim (222) of said well (20). The ten measurements were averaged to provide the average distance (D1). If any stop mechanism is located at the perimeter (103) of said plate (10) it is not comprised within the measurement as not been part of said perimeter (103).

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments or the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An applicator for applying a hair treatment composition to the hair, wherein said applicator comprises a plate and a well;

wherein said plate comprises a perimeter, an internal surface and an external surface; and wherein said well comprises a bottom and a wall, said wall emerging from said bottom and extending upwardly, said wall having a rim and said rim defining an opening and an internal volume of said well; and wherein said plate and said well are movably joined by a connection so that said applicator may alternate between a closed state and an open state, wherein when said applicator is in a closed state, said internal surface of said plate is in a juxtaposed relationship to said opening of said well and wherein when said applicator is in an open state, said internal surface of said plate is in a distal relationship to said opening of said well; wherein said applicator in said closed state has an average distance from said perimeter of said plate to said rim of said wall; wherein said applicator comprises at least one metering layer; wherein said at least one metering layer is selected from a group consisting of non-wovens, foams and combinations thereof; and wherein said at least one metering layer has a compressibility as defined herein of from about 59% to about 93% and a calliper of from about 0.40 mm to about 21.88 mm, wherein the ratio of said at least one metering layer calliper to said average distance is defined by mathematical relationship (I);

$$4.375 \times D1 \geqq \text{Calliper (mm)} \geqq 0.792 \times D1 \quad \text{(I)}.$$

2. The applicator according to claim 1, wherein said at least one metering layer is a first metering layer laid upon said rim of said well of said wall.

3. The applicator according to claims 2, wherein said applicator comprises said first and said second metering layers.

4. The applicator according to claim 3, wherein each of said first and said second metering layers independently have a calliper, wherein the calliper of the at least one metering layer is from about 0.63 mm to about 17.50 mm.

5. The applicator according to claim 3, wherein said compressibility of said first and said second metering layers is each independently from about 60% to about 85%.

6. The applicator (1) according to claim 2, wherein said first metering layer and said second metering layer have a substantially identical calliper.

7. The applicator according to claim 2, wherein said first metering layer and said second metering layer have a substantially identical compressibility as defined herein.

8. The applicator according to claim 1, wherein said at least one metering layer is a second metering layer laid upon said internal surface of said plate.

9. The applicator according to claim 1, wherein when said applicator is in closed state, said perimeter of said plate has an average distance from said rim of said wall of said well of from about 0.5 mm to about 5.0 mm.

10. The applicator according to claim 1, wherein at least one dipping means projects from said internal surface of said plate.

11. The applicator according to claim 10, wherein said at least one dipping means is a member, which projects from said internal surface of said plate.

12. The applicator according to claim 10, wherein said at least one dipping means comprises a first fin; wherein said first fin forms with said internal surface an angle $\alpha$ of from about 1° to about 90°.

13. The applicator according to claim 12; wherein said applicator further comprises a second fin, which projects from said internal surface of said plate independently from said first fin and wherein said second fin forms with said internal surface of said plate and independently from said first fin an angle $\beta$ of from about 1° to about 90°.

14. The applicator according to claim 13, wherein said first and second fin are substantially identical and form substantially identical angles $\alpha$ and $\beta$ and wherein said angles $\alpha$ and $\beta$ are from about 25° to about 55°.

15. The applicator according to claim 1, wherein said perimeter of said plate has a substantially identical extension of said rim of said wall of said well.

16. A kit-of part comprising an applicator according to claim 1; and one or more individually packaged hair treatment compositions.

17. The kit according to claim 16, wherein said one or more individually packaged hair treatment compositions comprises at least a first and a second individually packaged hair treatment composition, wherein said first and said second individually packaged hair treatment compositions are mixed to form a third hair treatment composition, wherein said first individually packaged hair treatment composition comprises an oxidizing agent and wherein said second individually packaged hair treatment composition comprises an alkalizing agent.

18. The kit according to claim 17, wherein said first individually packaged hair treatment composition comprises from about 3% to about 12% of hydrogen peroxide by weight of said first individually packaged hair treatment composition and wherein said second individually packaged hair treatment composition is in the form of a powder or paste and wherein said second individually packaged hair treatment composition comprises from about 10% to about 60% of persulfate salt selected from sodium persulfate, potassium persulfate, ammonium persulfate or mixtures thereof, by weight of said second individually packaged hair treatment composition.

19. The kit according to claim 17, wherein said first individually packaged hair treatment composition comprises from about 1.5% to about 12% of hydrogen peroxide by weight of said first individually packaged hair treatment composition and wherein said second individually packaged hair treatment composition comprises from about 0.01% to about 6% of a dye selected from direct dyes, oxidative dye precursors, oxidative dye couplers or mixtures thereof, by weight of said second individually packaged hair treatment composition.

20. The kit according to claim 17, further comprising instructions for using said applicator.

21. A method to apply a hair treatment composition with said applicator according to claim 1 to a hair strand comprising the steps of, loading said applicator comprises with said hair treatment composition, locating said hair strand between said plate and said well while said applicator is in a open state, bring said internal surface of said plate into a juxtaposed relationship to said opening of said well, and swiping said applicator along the length of said hair strand.

22. Use of one or more hair treatment compositions or combinations thereof selected from the group consisting of hair highlighting, dyeing compositions, perming compositions and styling compositions with at least two applicators according to claim 1 to provide a hair strand effects comprising the steps of:

loading a first applicator with said one or more hair treatment compositions locating said hair strand between said plate and said well while said first applicator is in a open state, bring said internal surface of said plate into a juxtaposed relationship to said opening of said well, and swiping said first applicator along the length of said hair strand;

loading a second applicator with said one or more hair treatment compositions locating said hair strand between said plate and said well while said second applicator is in a open state, bring said internal surface of said plate into a juxtaposed relationship to said opening of said well, and swiping said second applicator along the length of said hair strand.

23. The use according to claim 22, wherein said one or more hair treatment compositions have a rheology of from about 10 Pa to about 160 Pa at 1 $s^{-1}$.

24. The use according to claim 22, wherein said one or more hair treatment compositions is a highlighting composition.

* * * * *